US006243521B1

(12) United States Patent
Owaki et al.

(10) Patent No.: US 6,243,521 B1
(45) Date of Patent: Jun. 5, 2001

(54) FIBERS WITH OPTICAL FUNCTION

(75) Inventors: Shinji Owaki, Aichi; Toshimasa Kuroda, Osaka; Susumu Shimizu, Kanagawa; Akio Sakihara, Kanagawa; Kinya Kumazawa, Kanagawa; Hiroshi Tabata, Yokohama; Makoto Asano, Osaka; Hidekazu Takahashi, Yokohama, all of (JP)

(73) Assignees: Nissan Motor Co., Ltd., Yokohama; Tanaka Kikinzoku Kogyo K.K., Tokyo; Teijin Limited, Osaka, all of (JP)

( * ) Notice: Subject to any disclaimer, the term of this patent is extended or adjusted under 35 U.S.C. 154(b) by 0 days.

(21) Appl. No.: 09/202,977

(22) PCT Filed: Apr. 28, 1998

(86) PCT No.: PCT/JP98/01951

§ 371 Date: Dec. 24, 1998

§ 102(e) Date: Dec. 24, 1998

(87) PCT Pub. No.: WO98/50609

PCT Pub. Date: Nov. 12, 1998

(30) Foreign Application Priority Data

| | | |
|---|---|---|
| May 2, 1997 | (JP) | 9-114786 |
| Oct. 15, 1997 | (JP) | 9-282305 |
| Oct. 17, 1997 | (JP) | 9-285780 |

(51) Int. Cl.[7] ..... G02B 6/02

(52) U.S. Cl. ..... 385/123

(58) Field of Search ..... 385/123–120; 362/582, 583, 293

(56) References Cited

U.S. PATENT DOCUMENTS

| | | | |
|---|---|---|---|
| 5,407,738 | 4/1995 | Tabata et al. | 428/229 |
| 5,472,798 | 12/1995 | Kumazawa et al. | 428/690 |
| 5,746,178 | 5/1998 | Susaki et al. | 123/399 |

FOREIGN PATENT DOCUMENTS

| | | |
|---|---|---|
| 0686858 A2 | 6/1995 | (EP) . |
| 0767260 A2 | 4/1997 | (EP) . |
| 2 297 752 | 8/1996 | (GB) . |
| 43-14185 | 6/1943 | (JP) . |
| 59-228042 | 12/1984 | (JP) . |
| 60-1048 | 1/1985 | (JP) . |
| 60-24847 | 6/1985 | (JP) . |
| 62-170510 | 7/1987 | (JP) . |

(List continued on next page.)

OTHER PUBLICATIONS

Patent Abstracts of Japan, vol. 13, No. 394 (C–631), Aug. 31, 1989, JP 01 139803 A (Torray Ind Inc) Jun. 1, 1989.

Matsumoto et al, "Studies on the Photo–Controllable Coloring Fibers Part 1 : Photo–Controllable Coloring of Laminated Polymer Films by Optical Interference", Textile Machinery Society of Japan vol. 42, No. 2, pp. 55–62, 1989.

Matsumoto et al, "Studies on the Photo–Controllable Coloring Fibers Part 2 : Hue Analysis of the Photo–Controllable Coloring Films", Textile Machinery Society of Japan vol. 42, No. 10, pp. 60–68, 1989.

D.W. Van Krevelen "Properties of Polymers" pp. 298–305, no date available.

*Primary Examiner*—Frank G. Font
*Assistant Examiner*—Amanda Merlino
(74) *Attorney, Agent, or Firm*—Foley & Lardner

(57) ABSTRACT

A fiber with a cross section having x-axis and y-axis directions includes an alternate lamination including a predetermined number of a first portion and a second portion adjacent thereto, which have different optical characteristics, and a clad arranged around the alternate lamination.

31 Claims, 19 Drawing Sheets

FOREIGN PATENT DOCUMENTS

| | | |
|---|---|---|
| 63-64535 | 12/1988 | (JP) . |
| 4-136210 | 5/1992 | (JP) . |
| 4-202805 | 7/1992 | (JP) . |
| 7-34320 | 2/1995 | (JP) . |
| 7-97766 | 4/1995 | (JP) . |
| 7-97786 | 4/1995 | (JP) . |
| 7-166430 | 6/1995 | (JP) . |
| 7-195603 | 8/1995 | (JP) . |
| 7-331532 | 12/1995 | (JP) . |
| 9133038 | 5/1997 | (JP) . |
| 9133039 | 5/1997 | (JP) . |
| 9133040 | 5/1997 | (JP) . |
| WO 97/21855 | 6/1997 | (WO) . |

COMPOSITE FIBER OF POLYETHYLENE TEREPHTHALATE & POLYMETHYL METHACRYLATE a : FIBER HAVING ALTERNATE LAMINATION ONLY (COMPARATIVE EXAMPLE 4)

b : FIBER HAVING PROTECTIVE LAYER OF 4μm THICKNESS OF a (EXAMPLE 10)

c : FIBER HAVING REINFORCING LAYER OF 4μm THICKNESS IN THE CENTER OF ALTERNATE LAMINATION CORE OF b (EXAMPLE 11)

FIG.18

| | SUPPLY AMOUNT OF PET/PMMA (g / min) | FLATTENING RATIO | THICKNESS OF PET LAYER 41 (μm) | THICKNESS OF PMMA LAYER 42 (μm) | THICKNESS OF PROTECTIVE LAYER 44 (μm) | INTERFERENCE EFFECT | WEAR CHARACTER-ISTIC |
|---|---|---|---|---|---|---|---|
| EXAMPLE 1 | 40/27 | 6.2 | 0.21 | 0.21 | 4.2 | LIGHT COLORING(RED) | ◎ |
| EXAMPLE 2 | 30/20 | 6.3 | 0.17 | 0.19 | 3.6 | LIGHT COLORING(RED) | ◎ |
| EXAMPLE 3 | 15/10 | 6.2 | 0.13 | 0.15 | 2.5 | COLORING (GREEN) | ○ |
| EXAMPLE 4 | 10/7 | 6.5 | 0.10 | 0.09 | 2.1 | COLORING (GREEN-BLUE) | ○~△ |
| EXAMPLE 5 | 15/4 | 6.5 | 0.10 | 0.08 | 2.6 | COLORING (GREEN-BLUE) | ○ |
| COMPARATIVE EXAMPLE 1 | 6/4 | 6.7 | 0.07 | 0.08 | 1.6 | COLORING (BLUE) | × |

FIG.19

| | SUPPLY AMOUNT OF PC/PMMA (g / min) | FLATTENING RATIO | THICKNESS OF PC LAYER 41 (μm) | THICKNESS OF PMMA LAYER 42 (μm) | THICKNESS OF PROTECTIVE LAYER 44 (μm) | INTERFERENCE EFFECT | WEAR CHARACTER-ISTIC |
|---|---|---|---|---|---|---|---|
| EXAMPLE 6 | 40/27 | 7.1 | 0.18 | 0.19 | 3.6 | LIGHT COLORING(RED) | ◎ |
| EXAMPLE 7 | 30/20 | 7.5 | 0.15 | 0.16 | 3.0 | LIGHT COLORING(RED) | ◎ |
| EXAMPLE 8 | 15/10 | 7.2 | 0.11 | 0.13 | 2.4 | COLORING (GREEN) | ○ |
| EXAMPLE 9 | 15/4 | 7.5 | 0.09 | 0.07 | 2.3 | COLORING (GREEN-BLUE) | ○ |
| COMPARATIVE EXAMPLE 2 | 10/7 | 7.3 | 0.10 | 0.09 | 1.8 | COLORING (GREEN-BLUE) | × |
| COMPARATIVE EXAMPLE 3 | 6/4 | 7.8 | 0.06 | 0.07 | 1.3 | COLORING (BLUE) | × |

FIG.20

| | SUPPLY AMOUNT OF PEN/Ny-6 (g / min) | FLATTENING RATIO | THICKNESS OF PEN LAYER 41 (μm) | THICKNESS OF Ny-6 LAYER 42 (μm) | THICKNESS OF PROTECTIVE LAYER 44 (μm) | INTERFERENCE EFFECT | WEAR CHARACTER-ISTIC |
|---|---|---|---|---|---|---|---|
| EXAMPLE 18 | 40/27 | 5.8 | 0.24 | 0.23 | 4.4 | LIGHT COLORING(RED) | ◎ |
| EXAMPLE 19 | 30/20 | 5.9 | 0.21 | 0.22 | 4.1 | LIGHT COLORING(RED) | ◎ |
| EXAMPLE 20 | 15/10 | 6.0 | 0.15 | 0.16 | 2.8 | COLORING (YELLOW-GREEN) | ○ |
| EXAMPLE 21 | 10/7 | 6.2 | 0.13 | 0.13 | 2.4 | COLORING (GREEN) | ○~△ |
| COMPARATIVE EXAMPLE 6 | 6/4 | 6.6 | 0.08 | 0.07 | 1.5 | COLORING (BLUE) | × |

FIG.21

| | AMOUNT OF SODIUM SULFOISOPH-THALATE (mole %) | FLATTENING RATIO | THICKNESS OF PET LAYER 41 (μm) | THICKNESS OF Ny-6 LAYER 42 (μm) | THICKNESS OF PROTECTIVE LAYER 44 (μm) | INTERFERENCE EFFECT | WEAR CHARACTER-ISTIC |
|---|---|---|---|---|---|---|---|
| COMPARATIVE EXAMPLE 7 | 0.2 | 3.0 | 0.08 | 0.10 | 1.5 | COLORING(GREEN) (SOME BREAKAWAY) | × |
| EXAMPLE 22 | 0.2 | 3.2 | 0.08 | 0.09 | 4.0 | COLORING (GREEN) | ◎ |
| EXAMPLE 23 | 0.6 | 4.6 | 0.07 | 0.08 | 5.7 | COLORING (GREEN-BLUE) | ◎ |
| EXAMPLE 24 | 3.0 | 4.0 | 0.08 | 0.09 | 5.0 | COLORING (BLUE-GREEN) | ◎ |

FIBERS WITH OPTICAL FUNCTION

TECHNICAL FIELD

The present invention relates to fibers with optical function which ensure reflection and interference of radiation with a predetermined wavelength in the visible, infrared, or ultraviolet region.

BACKGROUND ART

Recently, many attempts are carried out to obtain a higher fabric quality by improving feeling of cloths through modification of the fiber section from a circle to, e.g. a star or combination of two or more polymers.

However, an improvement in deep color of fibers causes a reduction in luster thereof due to occurrence of dullnes and degradation of brightness. On the other hand, an improvement in luster causes a reduction in deep color due to increased surface reflection. The two are very difficultly compatible with each other.

JP 43-14185 discloses iridescent coated-type composite fibers including three layers. The fibers produce slight coloring by reflection and interference of light, but cannot show a deep interference color having a reflection spectrum with a predetermined wavelength due to insufficient number of layers.

Some references such as JP-A 59-228042, JP-B2 60-24847, and JP-B2 63-64535 propose coloring fibers or textiles including flat filaments obtained by joining different polymers. However, lamination of such flat filaments enables difficultly the thickness which allows interference of light, merely serving, theoretically, to restrain reflection light. The references define the shape of the flat section of a fiber for producing a color, and an angle of the longitudinal axis thereof with respect to the surface of a textile in any portion except a so-called structure point where warp and wheft cross completely so as to reinforce a coloring function of the textile. The references fail to show, however, various conditions indispensable to coloring by interference of light, such as thickkness and length of a layer and refractive index of a component, lacking practicability.

A journal of the Textile Machinery Society of Japan Vol. 42, No. 2, pp. 55–62, 1989 and Vol. 42, No. 10, pp. 60–68, 1989 describes laminated photocontrollable polymer films for producing colors by interference of light, wherein a film with anisotropic molecular orientation is interposed between two polarizing films. However, the films cannot be transformed into fine fibers or minute chips, having limited scope of application. Moreover, though the films produce an iridescence, a desired color cannot be obtained due to difficult control of a dominant wavelength to be reflected.

One method of producing a color by reflection and interference of light is to closely fill a fiber with particulates with uniform diameter such as latex particulates. However, fixing of the latex particulates is difficult to be done upon manufacturing to lose often a regularlity of arrangement thereof, obtaining no coloring function. Thus, this method is possible theoretically, but not pracitically.

It is, therefore, an object of the present invention to provide fibers with optical function which ensure, with improved feeling, production of a desired color or interception of infrared or ultraviolet rays by reflection and interference of radiation.

DISCLOSURE OF INVENTION

An aspect of the present invention lies in providing a fiber with a cross section having x-axis and y-axis directions, comprising:

an alternate lamination including a predetermined number of a first portion and a second portion adjacent thereto, said first and second portions having different optical characteristics; and a clad arranged around said alternate lamination.

BRIEF DESCRIPTION OF DRAWINGS

FIG. 18 is a table showing results of evaluation of the examples and the comparative example;

FIG. 19 is a view similar to FIG. 18, showing results of evaluation of the examples and the comparative example;

FIG. 20 is a view similar to FIG. 19, showing results of evaluation of the examples and the comparative example; and FIG. 21 is a view similar to FIG. 20, showing results of evaluation of the examples and the comparative example.

BEST MODE FOR CARRYING OUT THE INVENTION

Figure 1A:
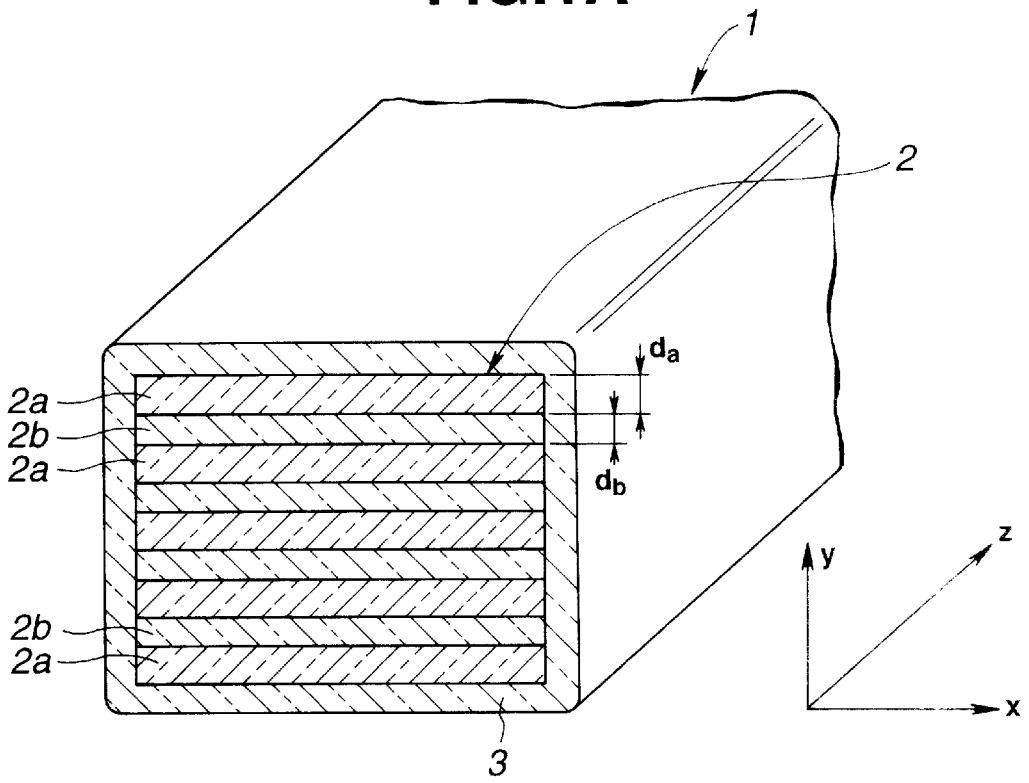
FIG. 1A is a perspective view showing a first embodiment of a fiber with optical function according to the present invention.

Referring to the drawings, a description will be made with regard to preferred embodiments of fibers with optical function.

FIGS. 1A–9 show a first embodiment of the present invention. Referring to FIG. 1A, a fiber 1 with optical function comprises a reflection/interference portion 2 including a first polymer 2*a* with smaller refractive index and a second polymer 2*b* with greater refractive index laminated thereto to obtain a predetermined wavelength of reflection and interference, and a clad portion 3 arranged around the reflection/interference portion 2 to provide luster to a fiber surface and mechanical function such as wear resistance.

Figure 1B:
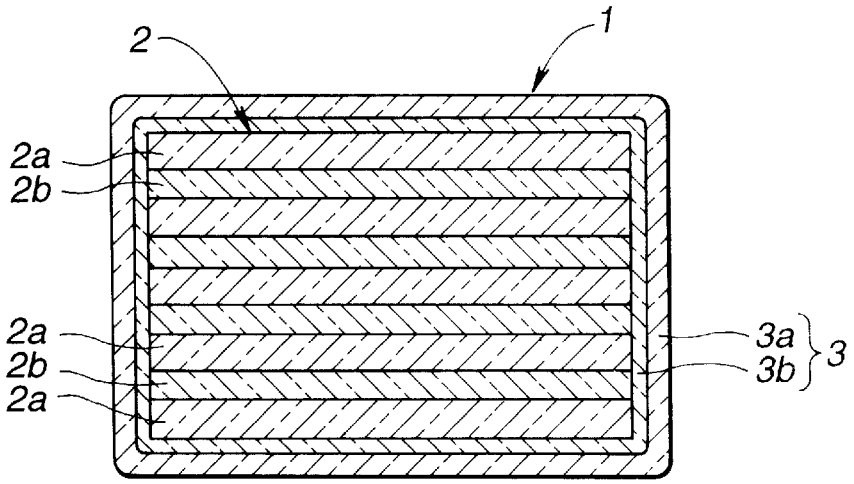
FIG. 1B is a cross section showing a variant of the first embodiment.

The clad portion 3 may be formed out of the same polymer as the first or second polymer 2*a*, 2*b* or a third polymer different therefrom. Moreover, the clad portion 3 may be in a two-layer structure including an outer layer 3*a* of the first polymer 2*a* and an inner layer 3*b* of the second polymer 2*b* as shown in FIG. 1B or including the first or second polymer 2*a*, 2*b* and the third polymer or including the third and fourth different polymers, or in a multilayer structure including three or more of the above polymers optionally combined. Such multilayer structure gives more complicated visual quality to the fiber 1. However, the structure including too many layers is not practical since it makes the manufacturing process complicated.

The polymers 2*a*, 2*b* include, preferably, resins which can be spun in the ordinary spinning process. Since radiation needs to enter lamination of the polymers 2*a*, 2*b* for obtaining interference of radiation, the polymers 2*a*, 2*b* need to have a certain translucency with respect to at least radiation with wavelength to be reflected.

Resins which meet such requirements include polymers such as polyester, polyacrylonitrile, polystyrene, polyamide, polypropylene, polyvinyl alcohol, polycarbonate, polymethyl methacrylate, polyether etherketone, polyparaphenylene terephthal amide, and polyphenylene sulfide. Moreover, such resins include mixtures of two or more of said polymers, and copolymers thereof.

Suppose that in the reflection/interference portion 2 including the first and second polymers 2*a*, 2*b* formed out of the above resins and constructed as shown in FIG. 1A, the first polymer 2*a* have a refractive index na and a thickness da, and the second polymer 2*b* have a refractive index nb and a thickness db. In a formula of interference of light which is applicable to a multilayer structure, a peak wavelength λ in the reflection spectrum is given by:

$$\lambda=2(nada+nbdb)$$

Therefore, if the kinds and thicknesses of the polymers 2*a*, 2*b* are determined to obtain λ=0.47 μm (=470 nm), blue reflection/interference light can be obtained. If they are determined to obtain λ=0.62 μm (=620 nm), red reflection/interference light can be obtained. Thus, cloths having the fiber 1 can produce blue, red, or other color, showing particular visual quality. Such color does not result from dyes, but interference of light, failing to fade away by ultraviolet rays, washing, etc.

The infrared spectrum of sunlight exists continuously from 0.78 to about 5.00 μm, showing high energy, particularly, in the near infrared region ranging from 0.78 to about 2.00 μm. Thus, if the peak wavelength λ is determined between 0.78 and about 5.00 μm and, preferably, between 0.78 and about 2.00 μm, reflection and intererence of infrared rays in sunlight can be obtained. Cloths having the fiber 1 can applied to summer goods such as blouses, shirts, suits, sport clothes, hats, and parasols, which effectively intercept or shut out infrared rays in sunlight, providing coolness to human bodies. Moreover, such cloths can be applied to interior and vehicular goods such as curtains, blind slats, seat cover, enabling restraint of a temperature rise in rooms and cabins.

In some work environments, various artificial heat sources such as a blast furnace, a combustion furnace, and a boiler exist, which are heated at several hundred to several thousand ° C. Infrared rays resultant from such heat sources are principally slightly greater in wavelength than those resultant from the sun. Generally, they are between 1.6 and 20.0 μm in wavelength. Working goods such as working clothes and protective covers manufactured from cloths having the fiber 1 serve to effectively intercept or shut out infrared rays emitted from heat sources by reflection, restraining a temperature rise of human bodies and objects. Moreover, household articles such as a cover for Japanse foot warmer, a hot carpet, and an electric blanket using the fiber 1 enable effective reflection of infrared rays, resulting in improved heating efficiency.

If the peak wavelength λ is determined in the ultraviolet region ranging from 0.004 to 0.400 μm, ultraviolet rays harmful to eyes and skin can be intercepted or shut out in the same way.

Figure 2:
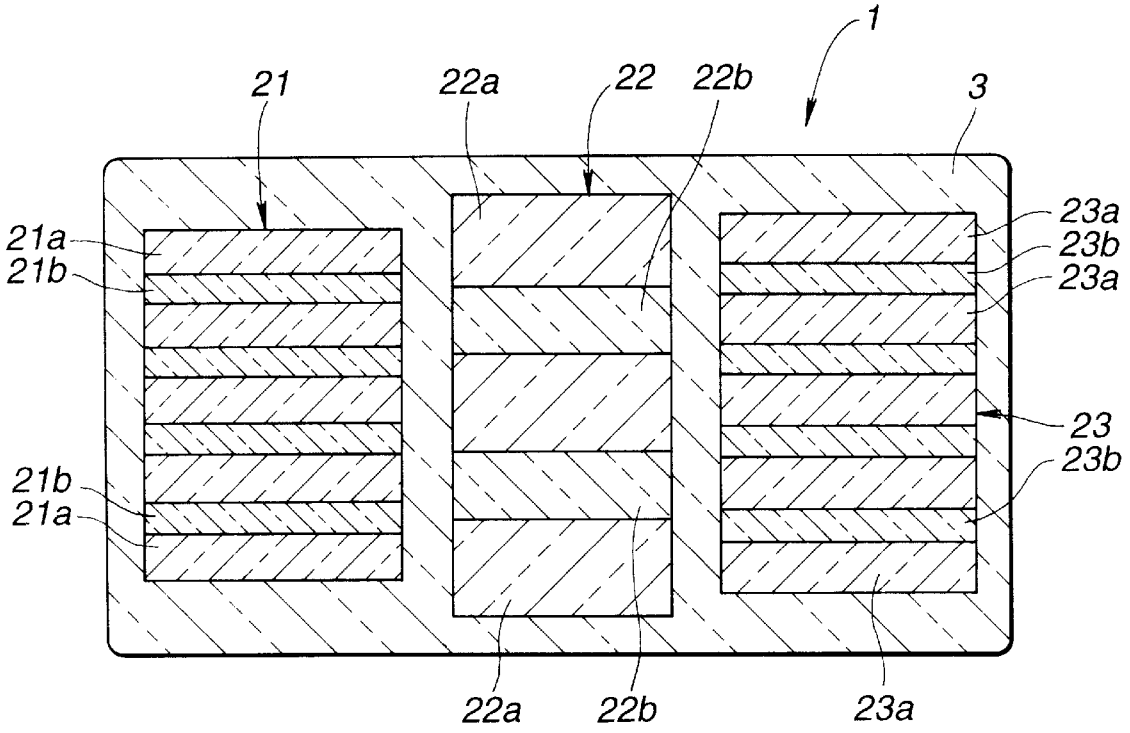
FIG. 2 is a view similar to FIG. 1B, showing another variant of the first embodiment.

Referring to FIG. 2, the fiber 1 may include reflection/interference portions 21, 22, 23 with different wavelengths of reflection and interference arranged parallel in one clad portion 3.

By way of example, with the first, second, and third reflection/interference portions 21, 22, 23, the kinds and thicknesses of the polymers 21*a*, 21*b*; 22*a*, 22*b*; 23*a*, 23*b* are determined to obtain blue reflection/interference light, infrared reflection wave, and red reflection/interference light, respectively, obtaining the fiber 1 with multifunction which can not only produce blue and red, but cut off infrared rays. The number of reflection/interference portions is not limited to three, and may be two or four or more.

The reflection/interference portions with different wavelengths of reflection and interference can be arranged in the longitudinal direction of the fiber 1 to vary a wavelength of reflection and interference by the length and position of the fiber 1. This enables achievement of the fiber 1 not only with multifunction, but with complicated color, feeling, and visual quality in combination with a weave.

The fiber 1 can be used not only in a long continuity, but in a short continuity for use, e.g. in spangled cloths, and in a short chip for use, e.g. in wallpapers and papers for shoji screen. It will be thus understood that the fiber 1 is applicable to various articles.

Since the refractive index of each of the above resins is generally between 1.3 and 1.8, a ratio nb/na of the refractive index nb of the second polymer 2*b* to the refractive index na of the first polymer 2*a* is between 1.01 and 1.40. If the ratio nb/na is less than 1.01, the refractive indexes na, nb of the two polymers 2*a*, 2*b* are substantially equal to each other, providing neither reflection nor interference of radiation.

Figure 3:
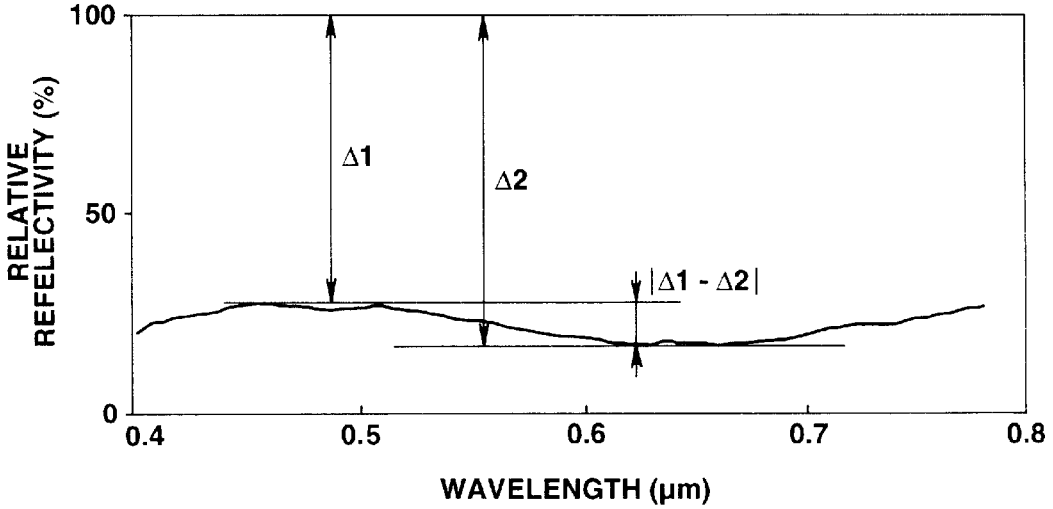
FIG. 3 is a graph illustrating a reflection spectrum of a boundary one of the standard color samples, which can barely visually be recognized as dim blue.

FIG. 3 shows results of measurement of a reflection spectrum of a boundary one (chroma C=2, hue H=5B, value V=5.0) of the standard color samples Chroma 6000, which can barely visually be recognized as dim blue. The reflection spectrum is measured at an incident angle of 0° and a receiving angle of 0° by a microspectrophotometer Model U-6000 manufactured by Hitachi Co., Ltd. Note that in FIG. 3, the relative reflectivity of 100% corresponds to diffuse reflection of a white board.

FIG. 3 reveals that when a difference between the diffuse reflectivity and the peak reflectivity is Δ1 in the white board, and a difference between the diffuse reflectivity of the white board and the background is Δ2, a difference in relative reflectivity |Δ1−Δ2| is 10%. As seen from FIG. 3, the difference in relative reflectivity |Δ1−Δ2| should be at least 10% to allow visual recognition of a predetermined color. It is confirmed that the results of measurement given by one of the standard color samples Chroma 6000 are similar to those of the fiber 1. It is also confirmed that with the same hue H and value V, as the chroma C becomes greater, the difference in relative reflectivity |Δ1−Δ2| becomes gradually larger.

On the other hand, referring to FIG. 1A, suppose that the fiber 1 extends in one-axis or Z-axis direction and has a cross section perpendicular thereto and having the direction parallel to the polymers 2*a*, 2*b* or the X-axis direction and the direction of lamination thereof or the Y-axis direction. When appropriate maintaining is ensured with regard to lengths dx, dy of the fiber 1 in the X-axis and Y-axis directions, which correspond to an optical thickness for giving a predetermined wavelength of reflection and interference, i.e. the prallelism of the polymers 2*a*, 2*b*, to define the dimensions of an effective lamination area in the X-axis and Y-axis directions, which can give a predetermined wavelength of reflection and interference, the relative reflectivity of the fiber 1 becomes greater as the length dx becomes greater, as the number of laminations becomes larger, and as the refractive-index ratio nb/na of the polymers 2*a*, 2*b* becomes higher.

Figure 4:
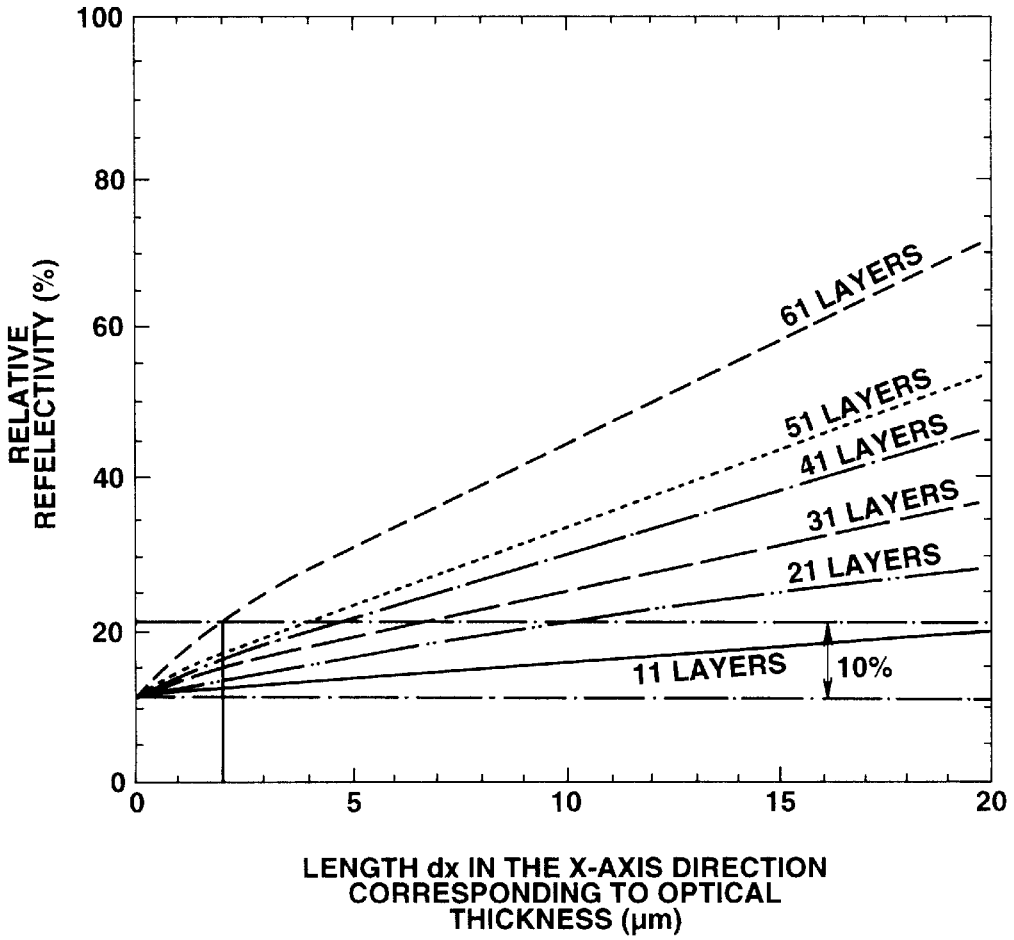
FIGS. 4–6 are views similar to FIG. 3, illustrating a relationship between the length in the X-axis direction, the number of laminations, and the relative reflectivity when the relative-index ratio of the polymers is 1.01, 1.07, and 1.40, respectively.
Figure 5:
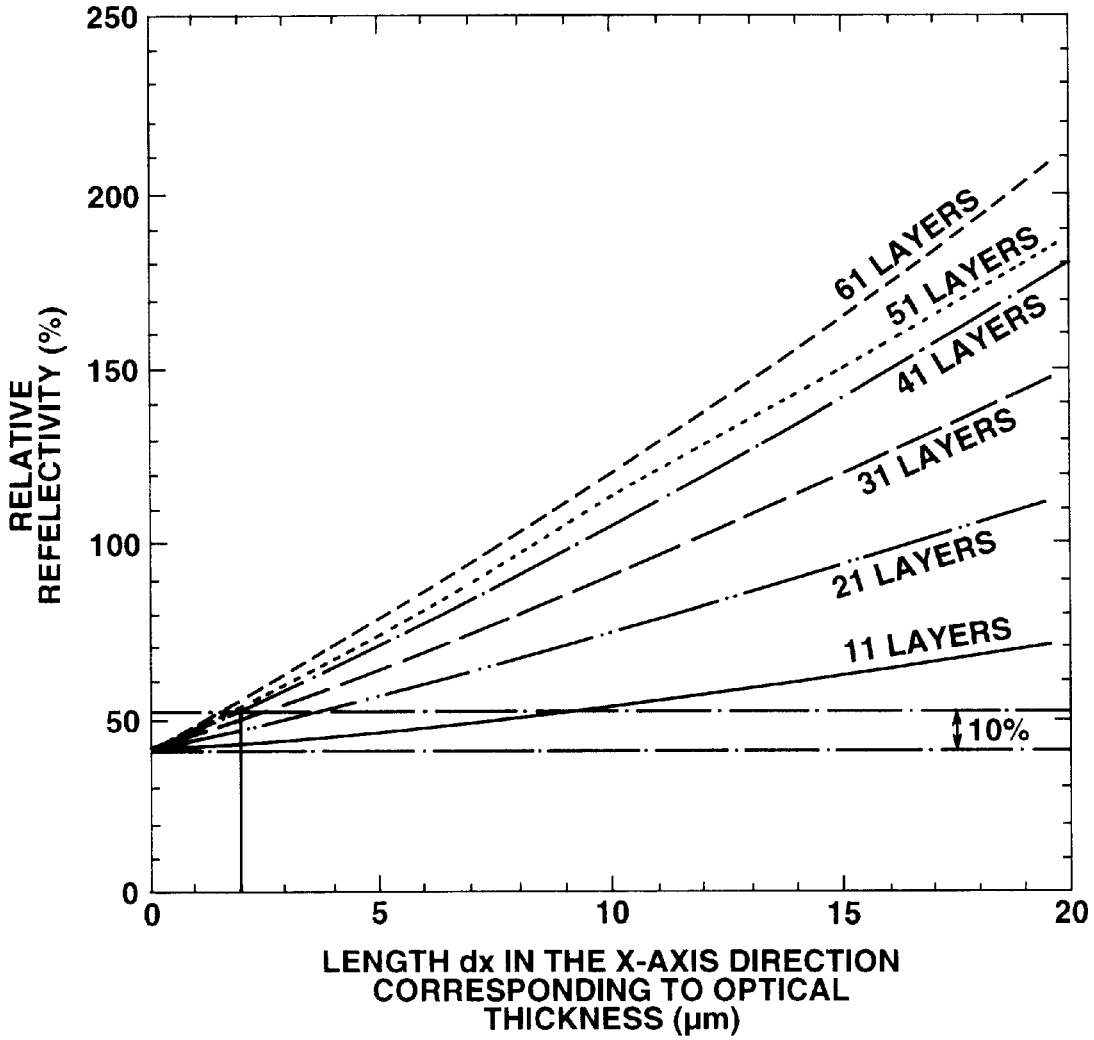
Figure 6:
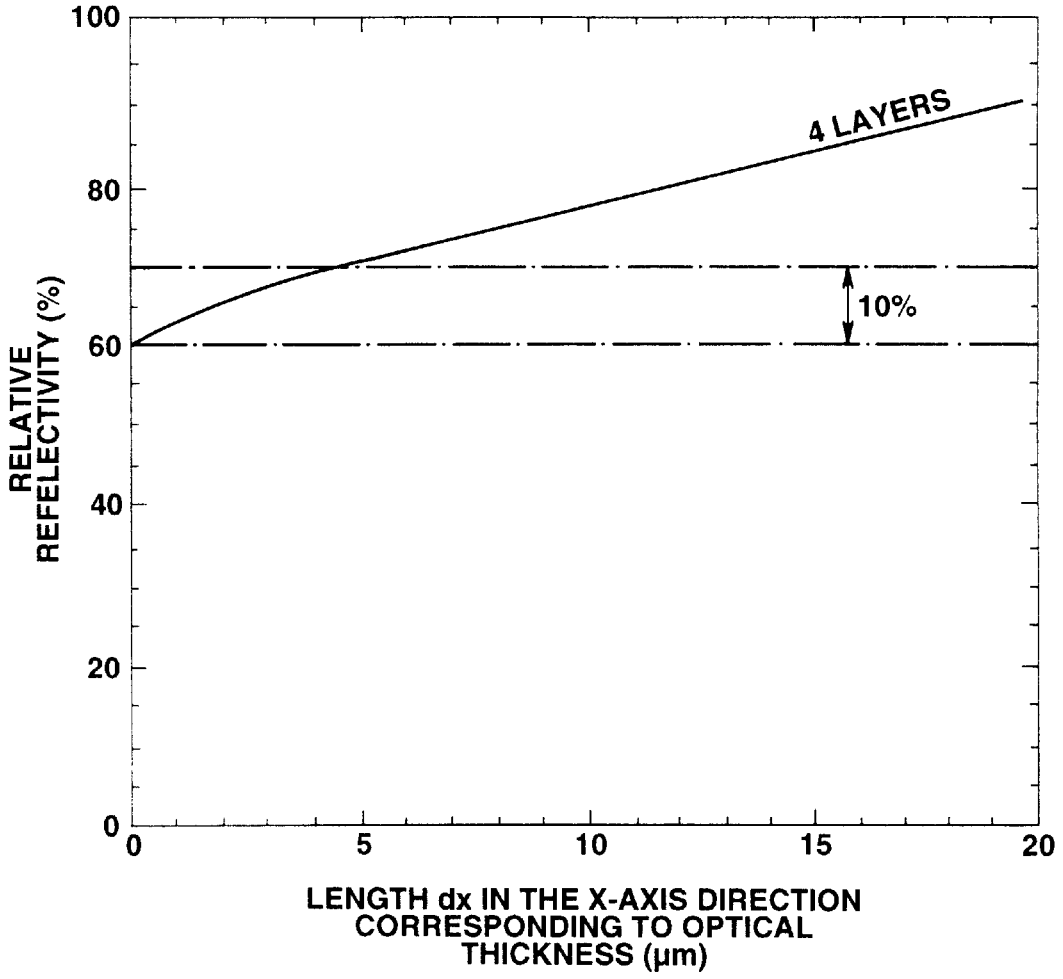

FIGS. 4–6 show a relationship between the length dx, the number of laminations, and the relative reflectivity when the relative-index ratio nb/na of the polymers 2*a*, 2*b* is 1.01, 1.07, and 1.40, respectively. Note that FIG. 6 only shows a case where the number of laminations is 4.

Find in FIGS. 4–6 a point where the difference in relative reflectivity |Δ1−Δ2| is equal to or more than 10% in the range of the length dx between 2.0 and 5.0 μm. In FIG. 4 where the relative-index ratio nb/na is a lower limit value of 1.01, the difference of 10% is obtained when the length dx is 2.0 μm, and the number of laminations is 61, allowing visual recognition of a color by relefection and interference of light.

Therefore, with the peak length λ set to 0.62 μm (red), since the thickness of one layer is about 0.1 μm, the total thickness dy of lamination is given by dy=0.1×61=6.0 μm, obtaining dx/dy=2.0/6.0 (μm)=0.3. With the peak length λ set to 0.47 μm (blue), since the thickness of one layer is about 0.075 μm, the total thickness dy of lamination is given by dy=0.075×61=4.6 μm, obtaining dx/dy=2.0/4.6 (μm)=0.4.

In FIG. 6 where the relative-index ratio nb/na is an upper limit value of 1.40, the difference of 10% is obtained when the length dx is 5.0 μm, and the number of laminations is 4, allowing visual recognition of a color by relefection and interference of light. The similar calculation gives that with the peak wavelength λ=0.62 μm (red), dy is 0.4 μm, obtaining dx/dy=5.0/0.4 (μm)=12.5, and that with the peak wavelength λ=0.47 μm (blue), dy is 0.32 μm, obtaining dx/dy=5.0/0.32 (μm)=15.6.

Lower and upper limits of dx/dy can be obtained from the cases where the relative-index ratio nb/na is 1.01 and 1.40. On condition that the length dx is between 2.0 and 5.0 μm, and the number of laminations is between 4 and 61, coloring by reflection and interference of light can visually be recognized when the ratio of the length dx to the length dy in the effective lamination area which can gives a predetermined wavelength of reflection and interference is between 0.3 and 16.0. In view of the fact that the number of laminations can technologically be increased to about 120, the ratio dx/dy is, preferably, between 0.1 and 16.0 to allow visual recognition of coloring by reflection and interference of light.

Figure 7:
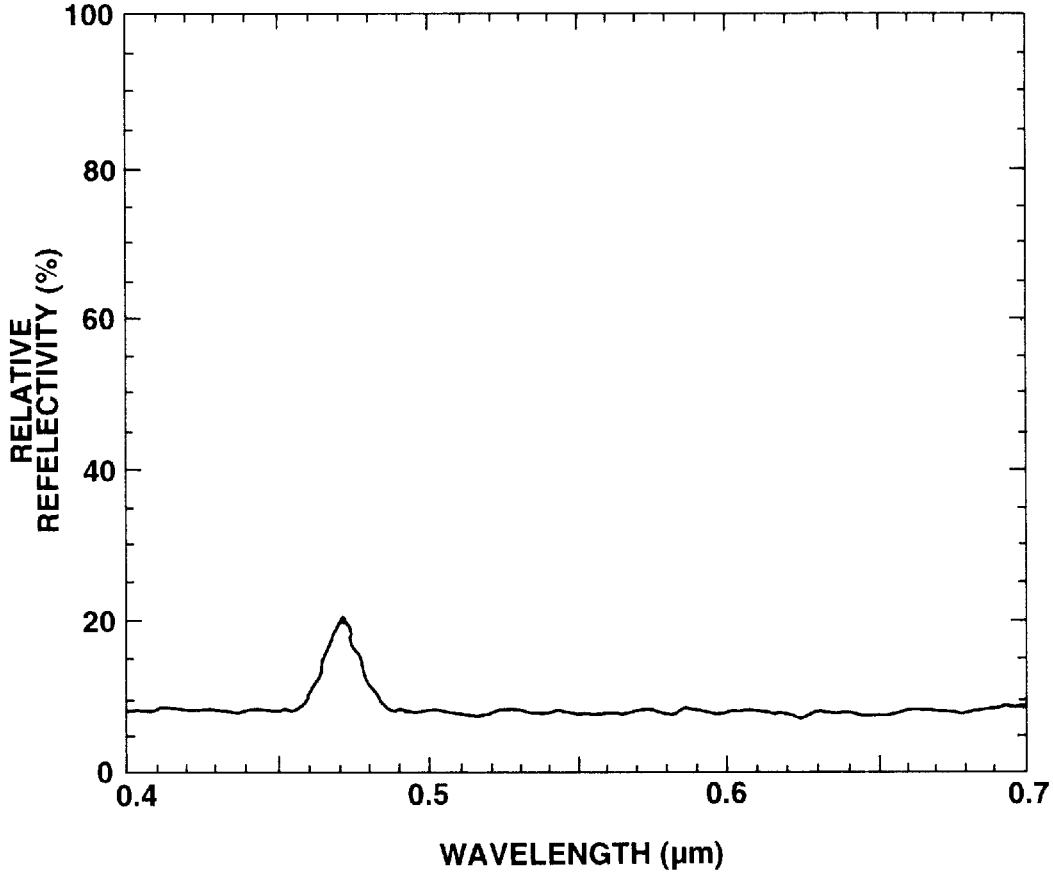
FIG. 7 is a view similar to FIG. 6, illustrating a spectrum when the refractive-index ratio is 1.01, the length in the X-axis direction is 2.0 $\mu$m, and the number of laminations is 61.

FIG. 7 shows a spectrum when the refractive-index ratio nb/na is 1.01, the length dx is 2.0 μm, and the number of laminations is 61. The spectrum in FIG. 7 is relatively similar in shape to that in FIG. 3 showing the bounday color sample which can visually be recognized as blue, though the latter is slightly broad in the vicinity of the peak wavelength.

Figure 8:
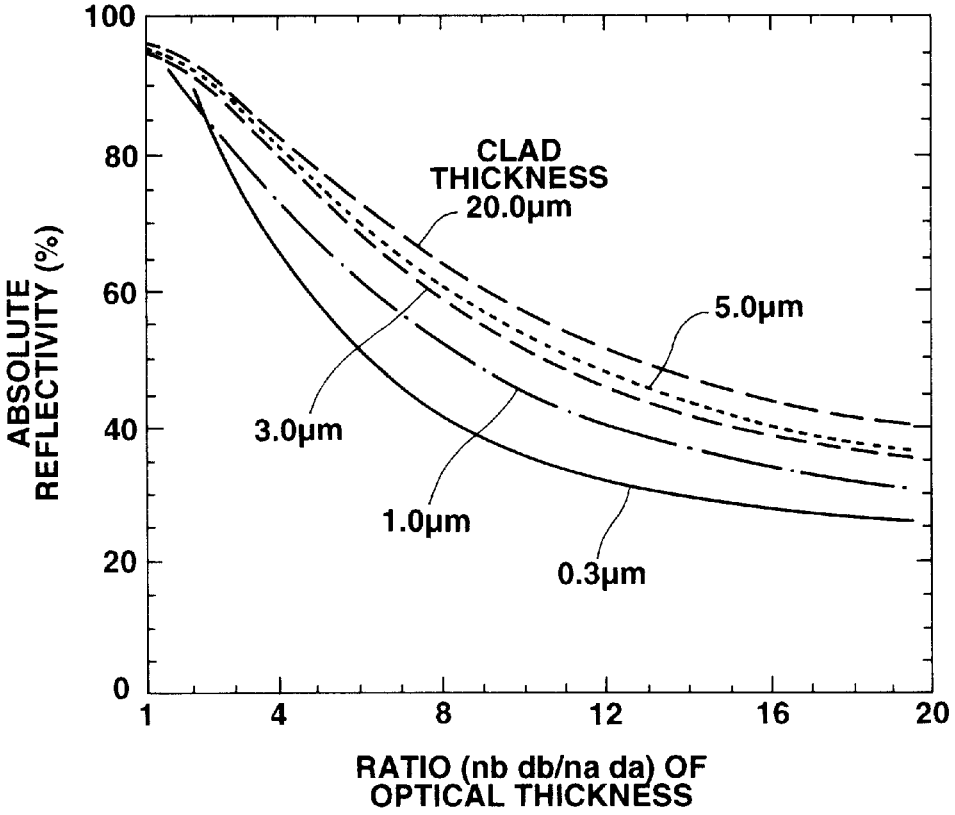
FIG. 8 is a view similar to FIG. 7, illustrating a relationship between the optical-thickness ratio, the reflectivity, and the thickness of a clad portion of the fiber.
Figure 9:
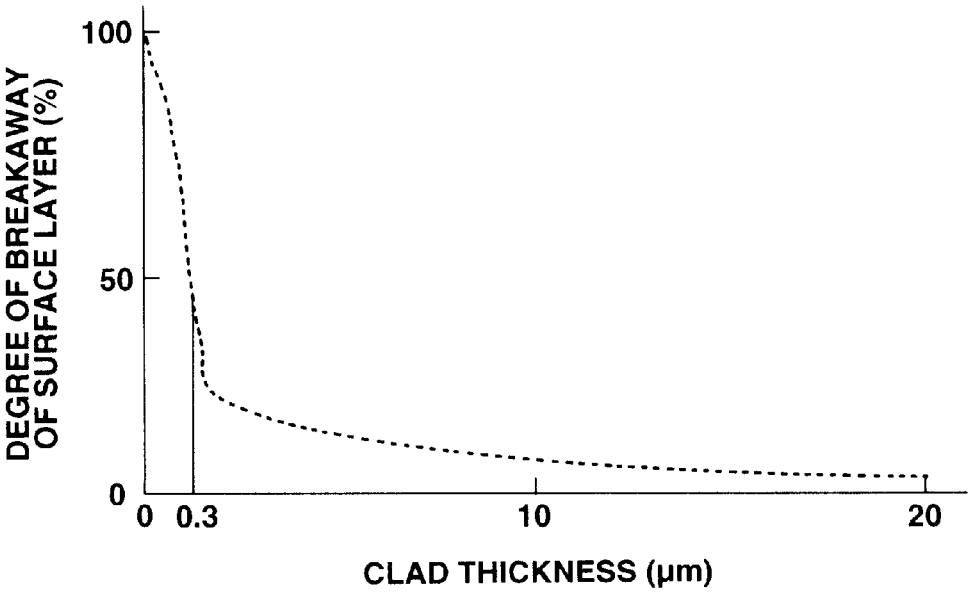
FIG. 9 is a view similar to FIG. 8, illustrating a relationship between the thickness of the clad portion and the degree of breakaway of the surface layer of a cloth using the fiber when applying a load thereto.

FIG. 8 shows a relationship between an optical-thickness ratio nbdb/nada, the reflectivity, and the thickness of the clad portion 3 with regard to the fiber 1 obtained by alternate lamination of polyamide with the refractive index na of 1.01 and polyethylene naphthalate with the refractive index nb of 1.63 and having the number of laminations of 61 and the refractive-index ratio nb/na of 1.07. FIG. 9 shows a relationship between the thickness of the clad portion 3 and the degree of breakaway of the surface layer of a cloth using the fiber 1 when applying a load of 100 g/cm$^2$ thereto.

FIG. 9 reveals that as soon as the thickness of the clad portion 3 becomes less than 0.3 μm, the degree of breakaway of the surface layer is increased suddenly. On the other hand, FIG. 8 reveals that with the thicknesses of the clad portion 3 between 0.3 and 20.0 μm, if the optical-thickness ratio nbdb/nada is in the vicinity of 1, values of the refectivity are substantially the same. It is thus understood that without any absorption of radiation in the visible region, the reflectivity is varied less. Therefore, the thickness of the clad portion 3 is determined, preferably, between 0.3 and 20.0 μm in view of achievement of the mechanical strength without having a bad influence on an optical system of the fiber 1.

An example 1 of the first embodiment will be described, wherein the first polymer 2*a* includes polyamide with the refractive index na of 1.53, and the second polymer 2*b* includes polyethylene naphthalate (PEN) with the refreractive index nb of 1.63. Thus, the refractive-index ratio nb/na is 1.07.

Using a spinneret for fibers having the number of laminations of 61, composite melt spinning is carried out at a spinning temperature of 274° C. and a take-up speed of 1,200 m/min. to obtain a unstretched fiber with alternate laminations of the first and second polymers 2*a*, 2*b* of 61, i.e. 30 pitches. Note that one pitch corresponds to a combination of one layer of the first polymer 2*a* and one layer of the second polymer 2*b*.

Then, heat stretching is carried out at a temperature of 140° C. and a take-up speed of 300 m/min. by a roller stretching machine, obtaining the fiber 1 including the reflection/interference portion 2 having the thicknesses da, db of the first and second polymers 2*a*, 2*b* of 0.077 μm and 0.072 μm (peak wavelength of reflection/interference light λ=0.470 μm) and the lengths dx, dy of the fiber 1 in the X-axis and Y-axis directions of 5.0 μm and 4.5 μm (thus dx/dy=1.1), which correspond to an optical thickness for giving a predetermined wavelength of reflection and interference, and the clad portion 3 of 5.0 μm thickness arranged around the reflection/interference portion 2 and including polyethylene naphthalate.

The clad portion 3 may be formed out of polyamide, or in a multilayer structure including polyethylene naphthalate and polyamide. In the latter case, the ratio of the thickness of the outer clad portion to that of the inner clad portion is determined, e.g. to 3:2.

The fiber 1 is evaluated by visual observation of coloring and measurement of the reflection spectrum at an incident angle of 0° and a receiving angle of 0° by the microspectrophotometer. Visual observation reveals that the fiber 1 produces transparent blue, whereas measurement of the reflection spectrum reveals that the peak wavelength λ exists in the vicinity of 0.47 μm, having the relative reflectivity of 80% which fully corresponds to the relative reflectivity obtained as a result of calculation based on FIG. 5.

An example 2 of the first embodiment will be described, wherein the first polymer 2*a* includes copolymerized PET, and the polymer 2*b* includes Ny-6.

Copolymerized PET is prepared as follows. 1.0 mole of dimethyl terephthalate, 2.5 mole of ethylene glycol, and a varied amount of sodium sulfoisophthalate, and 0.0008 mole of calcium acetate and 0.0002 mole of manganese acetate which serve as an ester interchange catalyzer are charged into a reactor tank for agitation. A mixture in the reactor tank is gradually heated between 150 and 230° C. in accordance with the known method to carry out ester interchange. After eliminating a predetermined amount of methanol, 0.0012 mole of antimony trioxide serving as polymerization catalyzer is charged in the reactor tank, which undergoes gradual temperature increase and pressure decrease. Then, in removing ethylene glycol produced, the reactor tank is put in the state of a temperature of 285° C. and a degree of vacuum of 1 Torr or less. Under those conditions maintained, an increase in viscosity of the mixture is waited. When torque required to an agitator reaches a predetermined value, a reaction is terminated to extrude the mixture in water, obtaining pellets of copolymerized PET. The intrinsic viscosity of copolymerized PET is between 0.47 and 0.64. Regarding Ny-6, the intrinsic viscosity is 1.3.

Using the two polymers, i.e. copolymerized PET and Ny-6, composite spinning is carried out at a take-up speed of 1,000 m/min. to obtain a unstretched fiber with a rectangular section as shown in FIG. 1A and the number of laminations of 61, i.e. 30 pitches. Filaments of the fiber are stretched by three times by a roller stretching machine to obtain stretched threads of 90 denier/11 filaments. The fiber 1 obtained in such a way includes the reflection/interference portion 2 having the thickness da of the first polymer 2*a* or PET layer of 0.086 $\mu$m and the thickness db of the second polymer 2*b* or Ny-6 layer of 0.090 $\mu$m ((peak wavelength of reflection/interference light $\lambda$=0.55 $\mu$m) and the lengths dx, dy of the fiber 1 in the X-axis and Y-axis directions of 5.0 $\mu$m and 4.5 $\mu$m (thus dx/dy=1.1), which correspond to an optical thickness for giving a predetermined wavelength of reflection and interference, and the clad portion 3 of 2.5 $\mu$m thickness arranged around the reflection/interference portion 2 and including coplymerized PET.

The fiber 1 is evaluated by visual observation of coloring and measurement of the reflection spectrum at an incident angle of 0° and a receiving angle of 0° by the microspectrophotometer. Visual observation reveals that the fiber 1 produces transparent green, whereas measurement of the reflection spectrum reveals that the peak wavelength $\lambda$ exists in the vicinity of 0.56 $\mu$m, having the relative reflectivity of 60%.

Figure 10A:
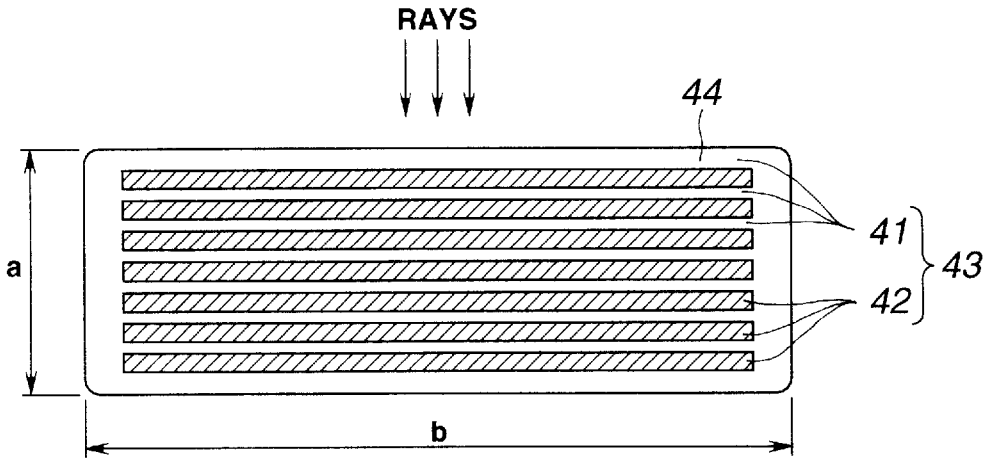
FIGS. 10A–10B are views similar to FIG. 1B, showing a second embodiment of the present invention.

FIGS. 10A–13B show a second embodiment of the present invention. Referring to FIG. 10A, a fiber comprises a core 43 including a first layer 41 of an organic polymer A with greater refractive index and a second layer 42 of an organic polymer B with smaller refractive index, and a clad or protective layer 44 arranged around the core 43 and formed out of the polymer A or B.

Figure 10B:
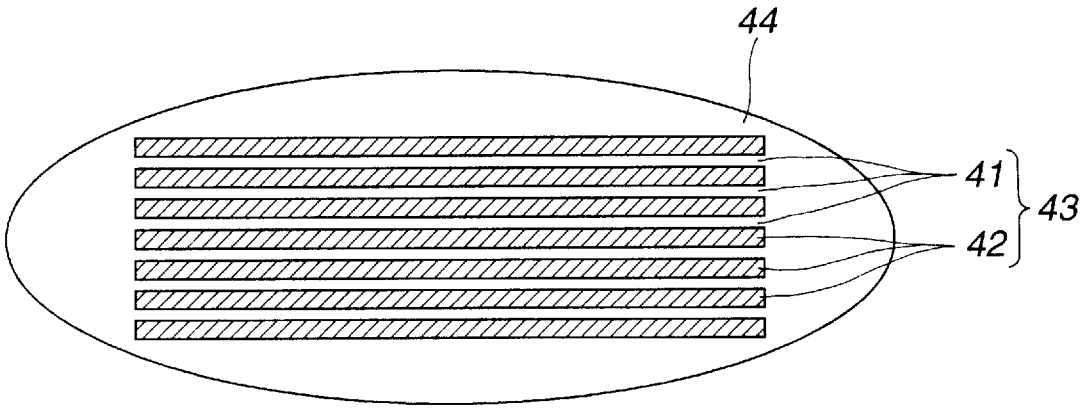
Figure 11A:
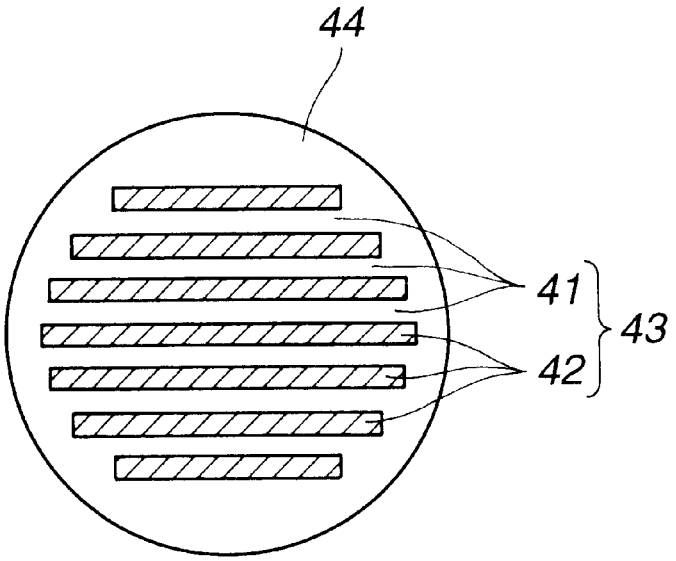
FIGS. 11A–11B are views similar to FIG. 10B, showing the second embodiment of the present invention.
Figure 11B:
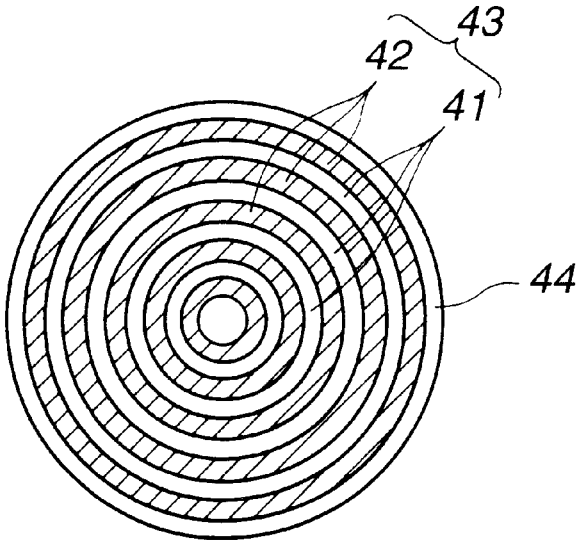

The section of the fiber may be rectangular as shown in FIG. 10A, or oval as shown in FIG. 10B, or circular as shown in FIGS. 11A–11B. The first and second layers 41, 42 of the core 43 may be disposed straightly equidistantly as shown in FIGS. 10A–11A, or concentrically equidistantly as shown in FIG. 11B.

The polymers A, B include polyester, polyethylene, polystyrene, polyamide, and fluorocarbon polymers. The polymers A, B with different refractive indexes may be of the same group, or of different groups.

A detailed description will be made with regard to combination of the polymers A, B. Crystalline polymers with greater refractive index allowing fiberization include aromatic polyesters such as polyethylene terephthalate (PET), polybutylene terephthalate, and polyethylene naphthalate. The refractive index is 1.64 (1.58 by calculation) in PET, 1.55 (=calculated value) in polybutylene terephthalate, and 1.63 (=calculated value) in polyethylene naphthalate. Amorphous polymers include, preferably, polycarbonate (PC) which has a refractive index of 1.59. Upon fiberization of the above polymers, molecular orientation is highly produced therein, resulting in greater composite refractive index. The double refractive index proper to crystal is 0.220 in PET, 0.153 in polybutylene terephthalate, 0.487 in polyethylene naphthalate, and 0.192 in PC. Thus, upon fiberization of the above polymers, a synergistic effect of the two refractive indexes is alive, particularly, in the longitudinal direction of a fiber.

In view of the fact that molecular orientation is apt to occur upon fiberization, polymers with smaller refractive index to be combined with the polymers with greater refractive index need not only to have smaller refractive index proper to polymer, but to show a degree of orientation which does not increase even in the stretching process or a double refractive index which does not increase upon orientation. As a consequence, the polymers should be amorphous, preferably, aliphatic (see *Properties of Polymers,* pp. 298–305, edited by D. W. van Krevelen, Elsevier Inc., 1990), and have a higher optical transparency, an affinity to polyester and polycarbonate as a polymer with greater refractive index, and an excellent adhesive property between layers. Polymers which meet such requirements include polymethyl methacrylate (PMMA) and polychloro methacrylate (PCMMA). Particularly, PMMA is preferable in view of its easy achievement with higher transparency and lower cost due to wide use in the form of plastics, optical fibers, etc. and structural aspect as polyester. Therefore, combination of aromatic polyester and polymethyl methacrylate or polycarbonate and polymethyl methacrylate is particularly preferable in view of easy achievement of higher interference of light in the state of a fiber with alternate lamination.

Referring to FIG. 10A, the structure of the fiber will be described. For obtaining efficient interference of light, the fiber is constructed, preferably, to include numerous layers, and put all interfaces therebetween substantially parallel to each other. Particularly, due to greater area effective in interference of light, a flat fiber is preferable which forms lamination of the first and second layers 41, 42 in the direction of a short side a of the section, and has a greater flattening ratio or ratio b/a of a long side b of the section to the short side a thereof. The flattening ratio b/a is, preferably, 2.0 or more, and particularly, 3.5 or more. With the flattening ratio b/a greater than 15.0, filature performance is largely decreased, so that the flattening ratio b/a is, preferably, less than 15.0, and particularly, less than 10.0.

Regarding the number of laminations of the first and second layers 41, 42, the minimum number is, preferably, 5 or more, and particularly, 10 or more. With the number of laminations less than 5, not only interference of light is insufficient, but an interference color is largley varied in accordance with the angles, merely showing cheap visual quality. On the other hand, the maximum number is, preferably, less than 70, and particularly, less than 50. With the number of laminations more than 70, not only an increased amount of reflection light cannot be expected, but the structure of a spinneret becomes too complicated to make a filature difficult and produce often a turbulence of polymer laminar flow.

The fiber with alternate lamination has an enormous contact area of the polymers A, B. Thus, with combination of polymers with lower affinity, a flat fiber having the short side a in the direction of lamination is difficult to be obtained due to great shrinkage force operating in the direction of interfaces as disclosed in JP-A 4-136210. It is undestood that polymers to be combined need to have an excellent affinity.

The thickness of each layer 41, 42 is between 0.01 and 0.40 $\mu$m. With the thickness smaller than 0.01 $\mu$m, the interface between the layers 41, 42 becomes obscur due to migration to/from the other layer, obtaining no interference of light. On the other hand, with the thickness greater than 0.40 $\mu$m, sufficient interference of light cannot be obtained. Moreover, for obtaining a fiber with particularly excellent interference of light, the thickness of each layer 41, 42 is, preferably, between 0.05 and 0.15 $\mu$m. Note that when an optical paths of the layers 41, 42 are of the same, i.e. the product of the thicknesses da, db of the layers 41, 42 and the refractive indexes na, nb thereof are equal to each other (nada=nbdb), more excellent interference of light can be obtained. Also note that when two times the sum of the optical paths of the layers 41, 42 which corresponds to primary reflection is equal to a wavelength $\lambda$ of a desired color ($\lambda$=2(nada+nbdb)), a maximum interference color can be obtained.

Referring to FIGS. 10A–11B, the fiber is of a core-and-sheath type including the core 43 and the clad 44 of the polymer A with greater refractive index arranged therearound. With such structure, light incident on the fiber has higher reflectivity, particularly, when passing from the first layer 41 with greater refractive index to the second layer 42 with smaller refractive index. If the number of laminations of the first and second layers 41, 42 is 5 or more, reflection is repeatedly carried out between the layers, obtaining extremely high reflectivity. Thus, as the number of laminations is larger, the reflectivity of the inside of the fiber is greater.

It is confirmed that the clad 44 contributes to an improvement not only in the mechanical strength of the fiber, but in the optical characteristic thereof. Calculation of the amounts of reflection light from the surface and inside of a fiber gives a surprising result contrary to former expectation. Specifically, light incident on a fiber is partly reflected by the surface, which interferes with reflection light from the inside. If the clad 44 is formed out of the polymer A with greater refractive index, the amount of reflection light from the surface is increased to balance with the amount of reflection light from the inside, obtaining increased amount of interference light. On the other hand, if the clad 44 is formed out of the polymer B with smaller refractive index, the amount of reflection light from the surface is smaller, obtaining no increased amount of interference light.

Due to its laminating structure, the core 43 has little resistance to external force such as friction. Here, formation of the clad 44 out of the polymer A with greater refractive index, the mechanical strength of which can be increased by molecular orientation, provides a great resistance to such external force. The minimum thickness of the clad 44 is, preferably, 0.3 $\mu$m or more, and particularly, 2.0 $\mu$m or more. If the thickness is smaller than 0.3 $\mu$m, the clad 44 breaks away from the core 43 easily, fulfilling no protective function. If the thickness is greater than 0.3 $\mu$m, the clad 44 ensures a great amount of interference light, and has sufficient mechanical strength, causing no breakaway by external force. On the other hand, the maximum thickness of the clad 44 is, preferably, 20.0 $\mu$m or less, and particularly, 10.0 $\mu$m or less. If the thickness is greater than 20.0 $\mu$m, absorption and scattering of light in the clad 44 are not negligible, which restrains takeout of interference light even if sufficient interference of light is obtained in the core 43. Moreover, the clad 44 corresponds to 5% or more per denier.

The clad 44 may include the polymer A with greater refractive index which constitutes the core 43, or other polymer with greater refractive index. Moreover, on condition that the clad 44 of the polymer A with greater refractive index has no dimensions such as refractive index and thickness which cancel or decrease reflection/interference light from the core 43, the fiber may include two or more clads 44, 44' as shown in FIGS. 12A–13B in place of one clad 44 as shown in FIGS. 10A–11B.

Figure 12A:
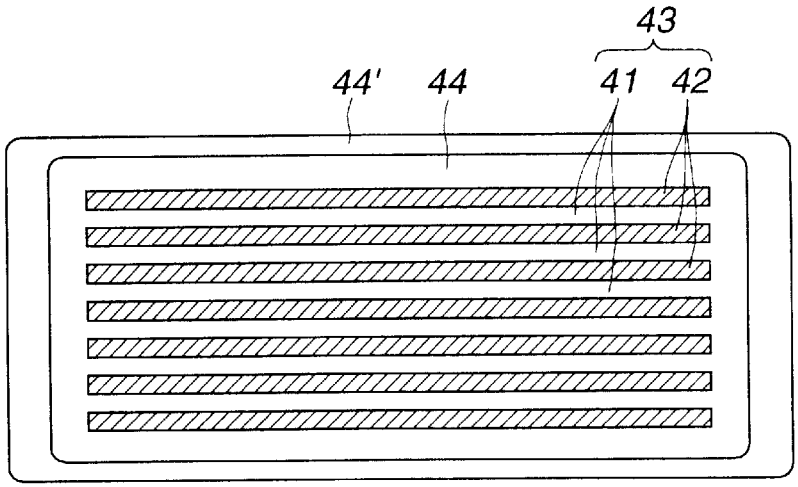
FIGS. 12A–12B are views similar to FIG. 11B, showing the second embodiment of the present invention.
Figure 12B:
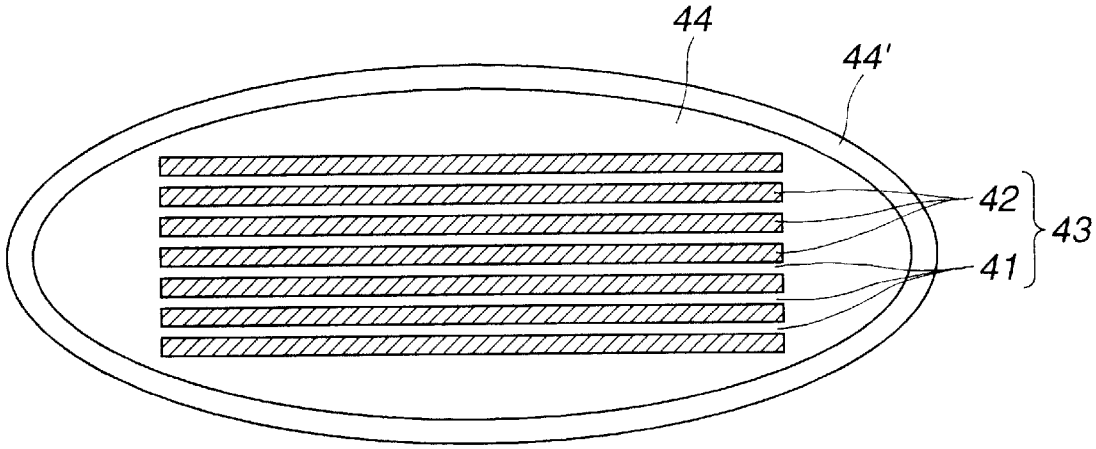
Figure 13A:
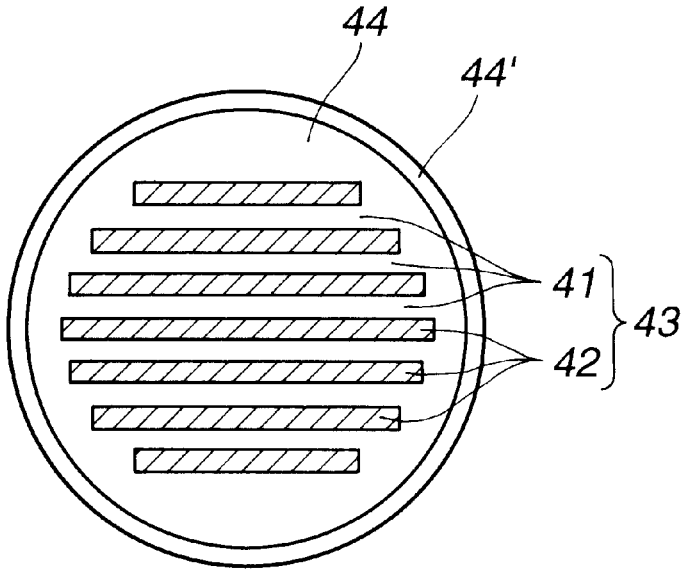
FIGS. 13A–13B are views similar to FIG. 12B, showing the second embodiment of the present invention.
Figure 13B:
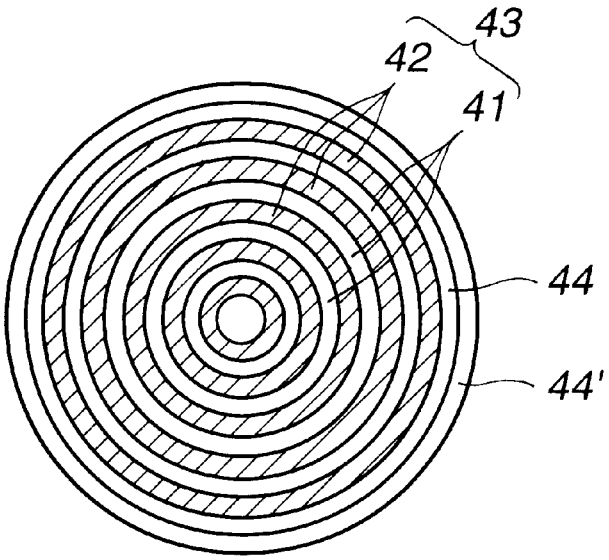

The fibers of the present invention can be manufactured in accordance with the known manufacturing method of composite fibers. By way of example, the fibers as shown in FIGS. 11B–12B are obtained such that two polymers are passed through a static mixer with a predetermined number of elements in a spinning pack, which is then guided by a flow divided plate and extruded from a spinneret inlet opening. The static mixer includes mixers disclosed, e.g. in JP-B2 60-1048 and connected to each other to form joined multilayer composite-polymer flow. A rectangular slit is adopted for the fiber as shown in FIG. 12A, whereas an oval slit is adopted for the fiber as shown in FIG. 12B. In such a way, the core-and-sheath type fibers are obtained including the core 43 and the clad 44 of the polymer with greater refractive index arranged therearound.

In order to obtain stable and effective reflection and interference of radiation with a predetermined wavelength, a spinneret for spinning a composite polymer fiber as disclosed, e.g. in JP 9-133038 and JP 133040 is, preferably, arranged in the spinning pack. Such spinneret enables achievement of the fibers having the core 43 and the clad 44 (44') as shown in FIGS. 12A–12B.

Moreover, the fibers of the present invention may be manufactured by spinning first the core 43 only, and forming then the outer periphery thereof with a polymer with greater refractive index according to the known method such as coating, spraying, or plasma polymerization to obtain the clad 44.

The section of the fiber is shaped, preferably, flat as shown in FIGS. 10A–10B and 12A–12B due to greater area effective in interference of light. Alternatively, it may be shaped in other forms. As described above, the flattening ratio b/a of the fiber is, preferably, 2.0 or more, and particularly, 3.5 or more. If the flattening ratio b/a is greater than 15.0, an extrusion opening of a spinneret has a flattening ratio greater than 50.0, which requires wide spread of joined multilayer composite-polymer flow in the direction perpendicular to the direction of lamination, often producing a turbulence of flow. Moreover, it causes bending of a polymer in the vicinity of the extrusion opening, so that the polymer contacts the spinneret, resulting in deteriorated spinnability. Thus, the flattening ratio b/a is, preferably, 15.0 or less, and particularly, 10.0 or less.

The polymer A with greater refractive index will be described in detail. Aromatic polyesters consist of aromatic dicarboxylic acid and aliphatic diol, and include PET, polybutylene terephthalate, and polyethylene naphthalate. Moreover, it is necessary to have copolymerized dicarboxilic acid and/or diol with alkyl group in a side chain.

Such alkyl group includes, preferably, methyl group, propyl group, butyl group, pentyl group, hexyl group, and higher alkyl group having more carbons. Moreover, alicyclic alkyl group such as cyclohexyl group is given in a preferred example. Note that methyl group is particularly preferable among them. The number of alkyl groups in the side chain may be one or more. However, too large number of alkyl groups in the side chain is not favorable due to its large obstruction to orientation/crystallization of aromatic polyesters.

Dicarboxilic acid with alkyl group, particularly, methyl group, in the side chain includes, preferably, dicarboxilic acid having the side chain out of aliphatic carbon such as 4,4'-diphenyl isopropylidene dicarboxilic acid, 3-methyl glutaric acid, or methyl malonic acid in view of easy orientation of alkyl group outward of a molecule, and thus easy interaction with polymethyl methacrylate. Moreover, glycol with alkyl group, particularly, methyl group, in the side chain includes, more preferably, to glycol having the side chain out of aliphatic carbon such as neopentyl glycol, bisphenol A, or bisphenol A with ethylene oxide added in view of easy interaction with polymethyl methacrylate. It is assumed that easy interaction of the above compounds results from two methyl groups found in the side chain.

The amount of copolymerization of a monomer with alkyl group in a side chain with respect to aromatic polyester is, preferably, between 5 and 30% with respect to all carbonoxilic-acid or glycol component, and particularly, between 6 and 15%. If the amount of copolymerization is smaller than 5%, a sufficient affinity of aromatic polyester to polymethyl methacrylate is not obtained, whereas if the amount of copolymerization is greater than 30%, characteristics of aromatic polyester as a main component, such as heat resistance and spinnability, are largely decreased.

Moreover, polymers may be applied which are obtained by copolymerizing such copolymerized aromatic polyester and other component. The other component includes aromatic dicarboxilic acids such as terephthalic acid, isophthalic acid, naphthalene dicarboxilic acid, biphenyl dicarboxilic acid, 4-4'-diphenyl ether dicarboxilic acid, 4-4'-diphenylmethane dicarboxilic acid, 4-4'-diphenylsulphone dicarboxilic acid, 1,2-diphenyxyethane-4',4"-dicarboxilic acid, anthracene dicarboxilic acid, 2,5-pyridine dicarboxilic acid, diphenylketone dicarboxilic acid, and sodium sulfoisophthalate, and ester forming derivatives thereof.

Moreover, the other component includes aliphatic dicarboxilic acids such as malonic acid, succinic acid, adipic acid, azelaic acid, and sebacic acid, alicyclic dicarboxilic acids such as decalin dicarboxilic acid, hydroxycarboxilic acids such as β-hydroxyethoxybenzoic acid, p-hydroxybenzoic acid, hydroxypropionic acid, and hydroxyacrylic acid, and ester forming derivatives thereof.

The number of aromatic dicarboxilic acids to be copolymerized may be only one or two or more. The amount of copolymerization of aromatic dicarboxilic acid with respect to the sum of aromatic dicarboxilic acid and the monomer having the side chain is, preferably, 30% or less with respect to all carboxilic-acid component, and particularly, 15% or less. If the amount of copolymerization is greater than 30%, the characteristics of the main component cannot be ensured sufficiently.

Aliphatic diol of aromatic polyester includes aliphatic diols such as ethylene glycol, trimethylene glycol, tetramethylene glycol, hexamethylene glycol, diethylene glycol, and polyethylene glycol, aromatic diols such as hydroquinone, catechol, naphthalene diol, resorcinol, bisphenol S, and bisphenol S with ethylene oxide added, and alicyclic diol such as cyclonhexane dimethanol. The number of diols to be copolymerized may be only one or two or more. The amount of copolymerization of aliphatic diol with respect to the sum of aliphatic diol and the diol having the side chain is, preferably, 30% or less with respect to all diol component, and particularly, 15% or less.

Moreover, aromatic polyester may include polyhydric carboxilic acids such as trimellitic acid, trimesic acid, pyromellitic acid, and tricarballylic acid, and polyhydric alcohols such as glyceline, trimethylol ethane, trimethylol propane, and pentaerythritol as far as aromatic polyester is substantially linear.

On the other hand, polycarbonate (PC), the other of the two polymers which can serve as the polymer A with grater refractive index, includes, preferably, PC consisting mainly of 4-4'-dihydrodiphenyl-2,2'-propane (bisphenol A) due to two methyl groups found in the side chain and possible copolymerization with bisphenol S or bisphenol S with ethylene oxide added. The amount of copolymerization of PC with respect to bisphenol A is, preferably, 30% or less, and particularly, 15% or less.

Figure 14A:
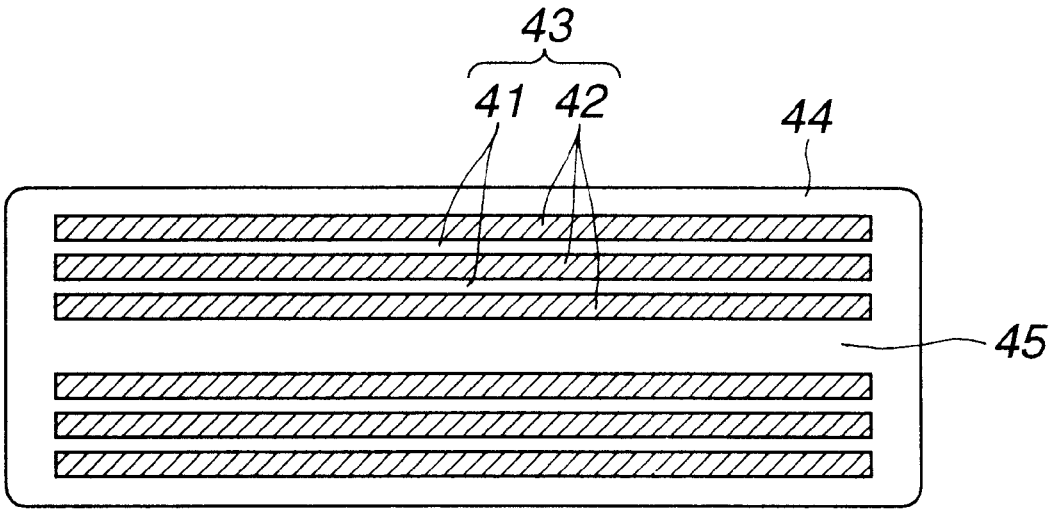
FIGS. 14A–14B are views similar to FIG. 13B, showing a variant of the second embodiment.
Figure 14B:
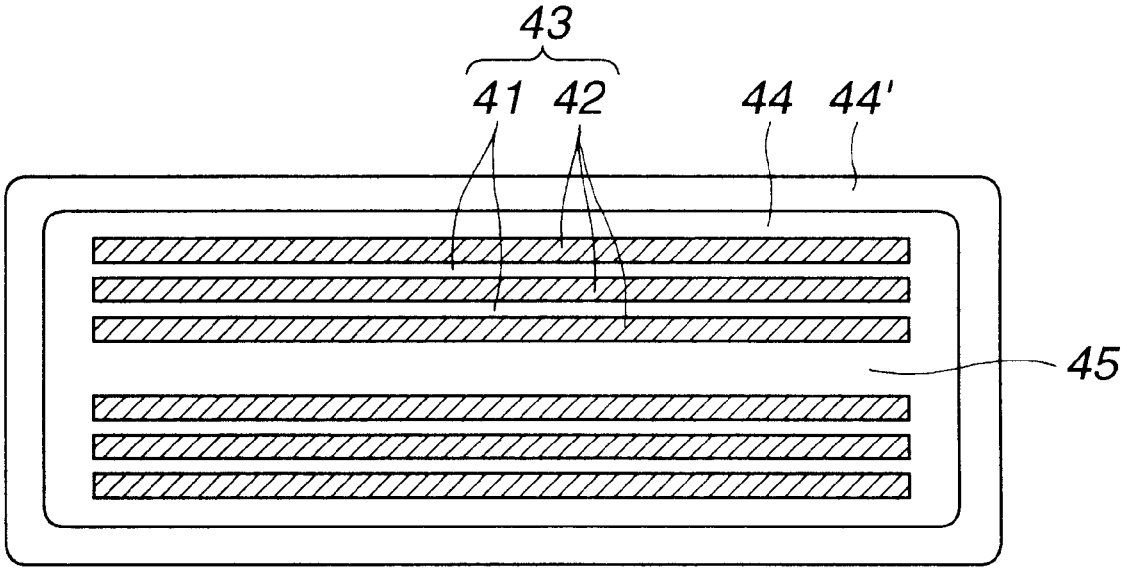

FIGS. 14A–14B show a variant of the second embodiment which is substantially the same as the first embodiment except that a clad or protective layer 44 is formed exclusively out of the polymer A with greater refractive index, and a reinforcement 45 formed out of the polymer A with greater refractive index or the polymer B with smaller refractive index is arranged in the core 43 to increase the mechanical strength of a fiber. The thickness of the reinforcement 45 is substantially the same as that of the clad 44, i.e. between 0.3 and 20.0 μm. Moreover, the reinforcement 45 corresponds to 5% or more per denier.

In this variant also, the fiber may include two or more clads 44, 44' as shown in FIG. 14B in place of one clad 44 as shown in FIG. 14A.

Moreover, in this variant, the section of the fiber is rectangular, alternatively, it may be oval, circular, polygonal, or star. Further, the first and second layers 41, 42 of the core 43 may be disposed straightly equidistantly or concentrically equidistantly.

Referring next to FIGS. 15–21, examples of second embodiment and comparaive examples will be described.

Examples 1–5 and a comparative example 1 will be described. In the examples 1–5, using PET of intrinsic viscosity of 0.70 having 12.5 mole % of neopentyl alcohl copolymerized as the polymer A with greater refractive index and Acripet MF (melt flow rate at 230° C.=14) manufactured by Mitsubishi Rayon Co., Ltd. as PMMA as the polymer B with smaller refractive index, composite spinning is carried out at a take-up speed of 1,500 m/min. to obtain the fibers including the core 43 and the clad 44 arranged therearound as shown in FIG. 10A. The number of laminations of PET and PMMA layers 41, 42 is 20. In the comparative example 1, a fiber including the core 43 only and no clad 44 is manufactured in the same way. Those fibers are stretched by a roller stretching machine by 1.5 times to obtain stretched threads with 12 filaments. The section of each stretched thread is photographed by an electron microscope to measure the thicknesses of the PET layer 41, the PMMA layer 42, and the clad 44 in the center of the section and a point thereof ⅛ the length of the long side b in the direction thereof (see FIG. 10A) distant from an end.

FIG. 18 shows an average thickness of the PET layer 41, the PMMA layer 42, and the clad 44. FIG. 18 reveals that if the thickness of the clad 44 is 2.0 μm or more, the fiber is excellent in interference of light and wear resistance. Regarding wear resistance, applying a load of 0.1 g/d and two twists, two filaments are rubbed together by 3,000 reciprocations. Evaluation of wear resistance is carried out with a microscope and is given by four grades of fuzz: no (◎), little (O), a little (Δ), and many (X).

Examples 6–9 and comprative examples 2–3 will be described. In the examples 6–9, using Panlight AD-5503 manufactured by TEIJIN LTD. as PC as the polymer A with greater refractive index and Acripet MF (melt flow rate at 230° C.=14) manufactured by Mitsubishi Rayon Co., Ltd. as PMMA as the polymer B with smaller refractive index, composite spinning is carried out at a take-up speed of 1,500 m/min. to obtain the fibers including the core 43 and the clad 44 arranged therearound as shown in FIG. 10A. The number of laminations of PC and PMMA layers 41, 42 is 20. In the comparative examples 2–3, fibers including the core 43 only and no clad 44 are manufactured in the same way. Those fibers are stretched by a roller stretching machine by 1.8 times to obtain stretched threads with 12 filaments. The section of each stretched thread is photographed by an electron microscope to measure the thicknesses of the PEC layer 41, the PMMA layer 42, and the clad 44 in the center of the section and a point thereof ⅛ the length of the long side b in the direction thereof (see FIG. 10A) distant from an end.

FIG. 19 shows an average thickness of the PC layer 41, the PMMA layer 42, and the clad 44. FIG. 19 reveals that if the thickness of the clad 44 is 2.0 μm or more, the fiber is excellent in interference of light and wear resistance. Regarding wear resistance, applying a load of 0.1 g/d and two twists, two filaments are rubbed together by 3,000 reciprocations. Evaluation of wear resistance is carried out with a microscope and is given by four grades of fuzz: no (◎), little (O), a little (Δ), and many (X).

Figure 15:
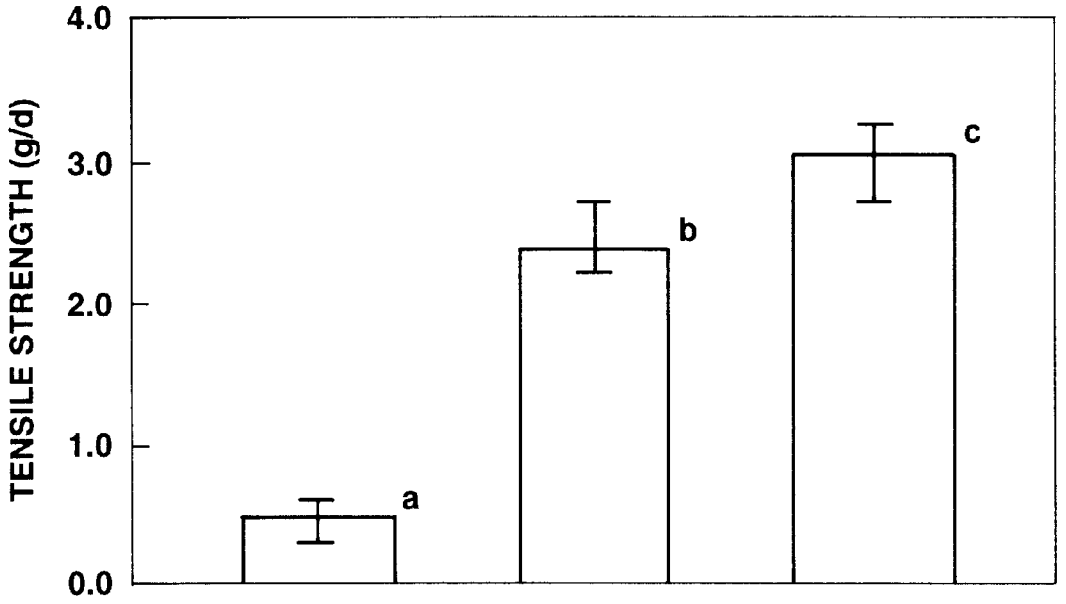
FIG. 15 is a view similar to FIG. 9, illustrating the tensile strength of the fibers in examples and a comparative example.

Examples 10–11 and a comparative example 4 will be described. Using PET as the polymer A with greater refractive index and PMMA as the polymer B with smaller refractive index, composite spinning is carried out in substantially the same way as in the examples 1 and 6 to obtain the fiber as shown in FIG. 10A (example 10), the fiber as shown in FIG. 14A including the reinforcement 45 arranged in the core 43 and having substantially the same thickness as that of the clad 45 (example 11), and a fiber including the core 43 only and no clad 44 (comparative example 4). The tensile strength of the fibers is measured, the results of which are given in FIG. 15. FIG. 15 reveals that formation of the clad 44 contributes to a large improvement and further increase in tensile strength.

Figure 16:
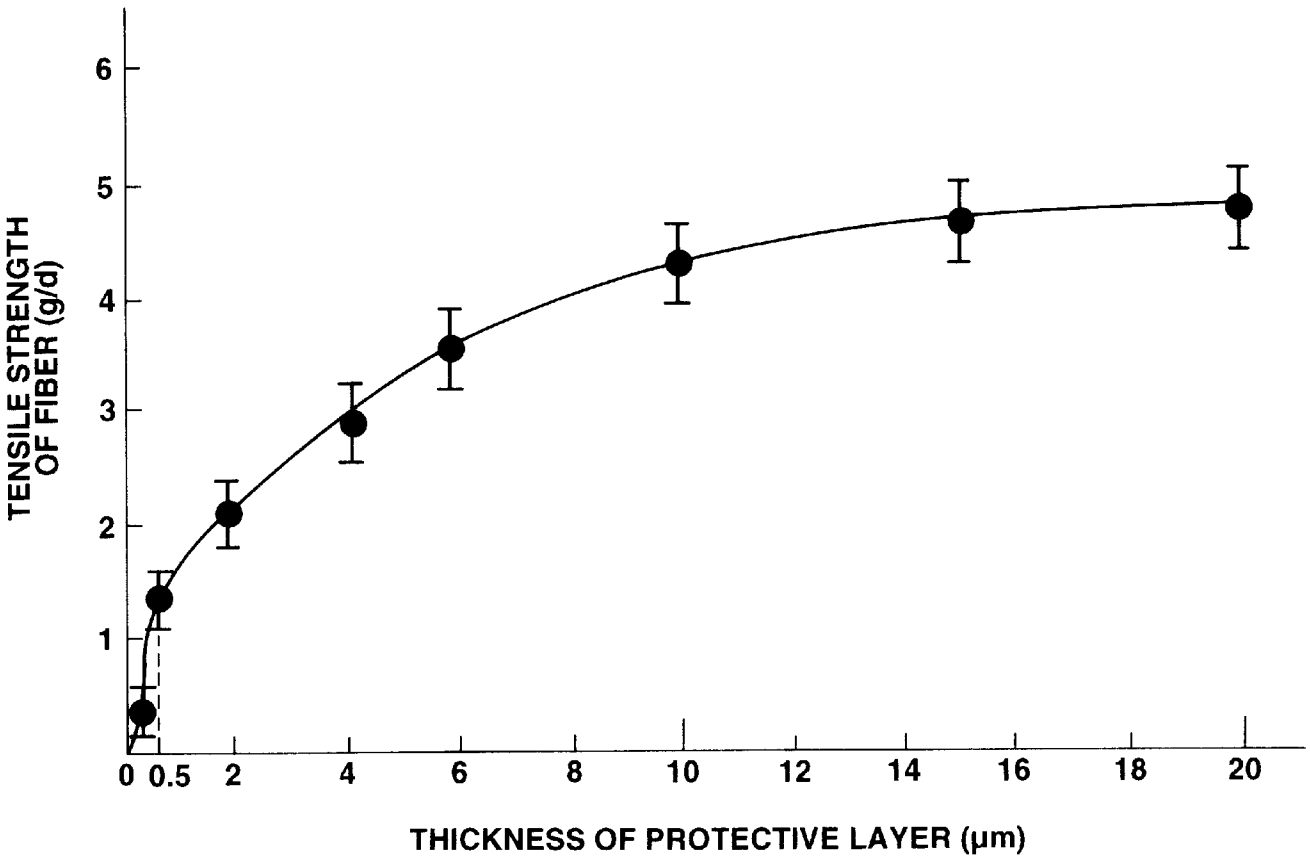
FIG. 16 is a a view similar to FIG. 15, illustrating a relationship between the thickness of a protective layer and the tensile strength of the fiber.

Examples 12–16 will be described. Using PET as the polymer A with greater refractive index and PMMA as the polymer B with smaller refractive index, composite spinning is carried out in substantially the same way as in the examples 1 and 6 to obtain the fiber as shown in FIG. 10A. With the same structure of the core 43, the thickness of the clad 44 of PET is determined differently in the exmaples: 1.0 μm in the example 12, 2.0 μm in the example 13, 4.0 μm in the example 14, and 6.0 μm in the example 15. The tensile strength of the fibers is measured, the results of which are given in FIG. 16. FIG. 16 reveals that the fiber with the clad 44 in the examples is greater in tensile strength than the fiber with no clad 44 in the comparative example 4 (see a in FIG. 15), that with the thickness of the clad 44 more than 1.0 μm, the tensile strength is greater than 1.0 g/d to show a practical value, and that as the thickness of the clad 44 increases, the tensile strength of the fiber also increases.

An example 17 and a comparative example 5 will be described. In the example 17, using PET as the polymer A with greater refractive index and PMMA as the polymer B with smaller refractive index, composite spinning is carried out in substantially the same way as in the example 13 to obtain the fiber as shown in FIG. 10A, the thickness of the clad 44 of which is 2.0 μm. In the comparative example 5, a fiber including the core 43 only and no clad 44 is manufactured in the same way as in the comparative example 4. The light reflection characteristics of the fibers are measured, the results of which are given in FIG. 17.

Figure 17:
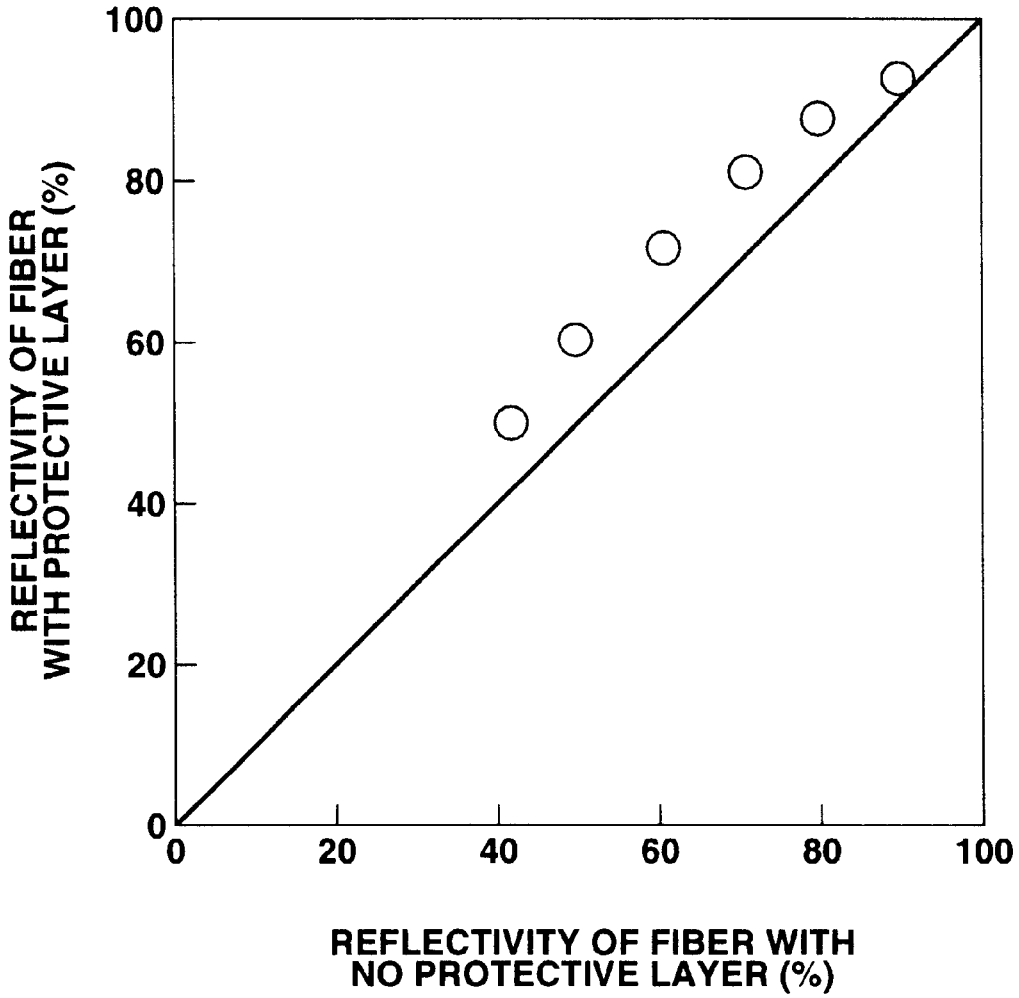
FIG. 17 is a view similar to FIG. 16, illustrating light reflection characteristics of the fibers in an example and a comparative example.

Referring to FIG. 17, the light reflection characteristics of the fibers show, with 470 nm main wavelength of reflection light, the relationship between the reflectivity of the main wavelength in the comparative example 5 which varies from 30 to 90% and the corresponding reflectivity thereof in the example 17. FIG. 17 reveals that the fiber with the clad 44 in the example 17 is excellent in reflectivity of the main wavelength than the fiber with no clad 44 in the comparative example 5 in any range.

Examples 18–21 and a comparative example 6 will be described. In the examples 18–21, using PEN of intrinsic viscosity of 0.58 having 1.5 mole % of sodium sulfoisophthalate copolymerized as the polymer A with greater refractive index and nylon 6 (Ny-6) of intrinsic viscosity of 1.30 as the polymer B with smaller refractive index, composite spinning is carried out at a take-up speed of 1,500 m/min. to obtain the fibers including the core 43 and the clad 44 arranged therearound as shown in FIG. 10A. The number of laminations of copolymerized PEN and Ny-6 layers 41, 42 is 20. In the comparative example 6, a fiber including the core 43 only and no clad 44 is manufactured in the same way. Those fibers are stretched by a roller stretching machine by 1.9 times to obtain stretched threads with 12 filaments. The section of each stretched thread is photographed by an electron microscope to measure the thicknesses of the copolymerized PEN layer 41, the Ny-6 layer 42, and the clad 44 in the center of the section and a point thereof ⅛ the length of the long side b in the direction thereof (see FIG. 10A) distant from an end.

FIG. 20 shows an average thickness of the copolymerized PEN layer 41, the Ny-6 layer 42, and the clad 44. FIG. 20 reveals that if the thickness of the clad 44 is 0.3 μm or more, and particularly, 2.0 μm or more, the fiber is excellent in interference of light and wear resistance. Regarding wear resistance, applying a load of 0.1 g/d and two twists, two filaments are rubbed together by 3,000 reciprocations. Evaluation of wear resistance is carried out with a microscope and is given by four grades of fuzz: no (◎), little (O), a little (Δ), and many (X).

It is confirmed from the examples and comparative examples that the fibers of the present invention are excellent in interference of light and wear resistance.

Examples 22–24 and a comparative example 7 will be described. In the examples 22–24, copolymerized PET serves as the polymer A with greater refractive index, and Ny-6 serves as the polymer B with smaller refractive index. The use of copolymerized PET aims to increase compatibility with Ny-6 or prevent breakaway.

Copolymerized PET is prepared as follows. 1.0 mole of dimethyl terephthalate, 2.5 mole of ethylene glycol, and a varied amount of sodium sulfoisophthalate, and 0.0008 mole of calcium acetate and 0.0002 mole of manganese acetate which serve as an ester interchange catalyzer are charged into a reactor tank for agitation. Note that the amount of sodium sulfoisophthalate is varied in accordance with the examples 22–24 and the comparative example 7 as shown in FIG. 21. A mixture in the reactor tank is gradually heated between 150 and 230° C. in accordance with the known method to carry out ester interchange. After eliminating a predetermined amount of methanol, 0.0012 mole of antimony trioxide serving as polymerization catalyzer is charged in the reactor tank, which undergoes gradual temperature increase and pressure decrease. Then, in removing ethylene glycol produced, the reactor tank is put in the state of a temperature of 285° C. and a degree of vacuum of 1 Torr or less. Under those conditions maintained, an increase in viscosity of the mixture is waited. When torque required to an agitator reaches a predetermined value, a reaction is terminated to extrude the mixture in water, obtaining pellets of copolymerized PET. The intrinsic viscosity of copolymerized PET is between 0.47 and 0.64. Regarding Ny-6, the intrinsic viscosity is 1.3.

Using the two polymers, i.e. copolymerized PET and Ny-6, composite spinning is carried out at a take-up speed of 1,000 m/min. to obtain the fiber including the core 43 and the clad 44 arranged therearound as shown in FIG. 10A and the number of laminations of 61, i.e. 30 pitches. In the comparative example 7, a fiber including the core 43 only and no clad 44 is manufactured in the same way. Filaments of those fibers are stretched by three times by a roller stretching machine to obtain stretched threads of 100 denier/11 filaments.

A section of each stretched thread is photographed by an electron microscope to measure the thicknesses of the copolymerized PET layer 41 and the Ny-6 layer 42 in the center of the section and a point thereof ⅛ the length of the long side b in the direction thereof (see FIG. 10A) distant from an end. An average thickness of the copolymerized PET layer 41 and the Ny-6 layer 42 is given in FIG. 21. FIG. 21 reveals that if the thickness of the clad 44 is 0.3 μm or more, and particularly, 2.0 μm or more, the fiber is excellent in interference of light and wear resistance. Regarding wear resistance, applying a load of 0.1 g/d and two twists, two filaments are rubbed together by 3,000 reciprocations. Evaluation of wear resistance is carried out with a microscope and is given by four grades of fuzz: no (◎), little (O), a little (Δ), and many (X).

In case that a compatible agent is added to one of PET and Ny-6 to improve compatibility thereof, if the amount of the compatible agent is too large, the melt viscosity thereof is decreased to have a bad influence on formability of lamination, resulting in lowered reflection and interference of light.

An example 25 and a comparative example 8 will be described. In the example 25, PET serves as the polymer A with greater refractive index, and Ny-6 serves as the polymer B with smaller refractive index. The compatible agent such as sodium alkylbenzene sulfonate or polyester amide is added to PET to increase compatibility with Ny-6 or prevent breakaway, obtaining pellets of PET. PET includes a dicarboxylic-acid component including phthalic or isophthalic acid and partly having a coordinate function given by a cationic agent. The cationic agent includes metallic salt of sulfonic acid. The dicarboxylic-acid component partly includes metallic salt of sulfoisophthalic acid.

Using the two polymers, i.e. PET containing sodium alkylbenzene sulfonate and Ny-6, composite spinning is carried out at a take-up speed of 1,000 m/min. to obtain the fiber with a rectangular section as shown in FIG. 10A and the number of laminations of 61, i.e. 30 pitches. In the comparative example 8, a fiber including the core 43 only and no clad 44 is manufactured in the same way. Filaments of those fibers are stretched by three times by a roller stretching machine to obtain stretched threads of 100 denier/11 filaments.

A section of each stretched thread is photographed by an electron microscope to measure the thicknesses of the PET layer 41 and the Ny-6 layer 42 in the center of the section and a point thereof ⅛ the length of the long side b in the direction thereof (see FIG. 10A) distant from an end. An average thickness of the PET layer 41 and the Ny-6 layer 42 is given in FIG. 21. FIG. 21 reveals that if the thickness of the clad 44 is 0.3 μm or more, and particularly, 2.0 μm or more, the fiber is excellent in interference of light and wear resistance.

Having described the present invention with regard to the preferred embodiments, it is noted that the present invention is not limited thereto, and various changes and modifications can be made without departing from the scope of the present invention.

INDUSTRIAL APPLICABILITY

Fibers with optical function are obtained which ensure, with improved feeling, production of a desired color or interception of infrared or ultraviolet rays by reflection and interference of radiation.

It is noted that the contents of Japanese Applications Nos. P9-114786, P9-285780, and P9-282305 are hereby incorporated by reference.

What is claimed is:

1. A fiber with a cross section having x-axis and y-axis directions, comprising:

an alternate lamination including a predetermined number of a first portion and a second portion adjacent thereto, said first and second portions having different optical characteristics; and a clad arranged around said alternate lamination, said clad having a thickness between 0.3 and 20.0 μm, said thickness being given by a length between planes of incidence of said alternate lamination and said clad with respect to radiation perpendicularly incident on said plane of incidence of said clad.

2. A fiber as claimed in claim 1, wherein when said alternate lamination has lengths dx, dy in the x-axis and y-axis directions, a ratio of said length dx to said length dy is between 0.1 and 16.0.

3. A fiber as claimed in claim 1, wherein said predetermined number of said first and second portions is five or more.

4. A fiber as claimed in claim 1, wherein said first and second portions include resins.

5. A fiber as claimed in claim 4, wherein said first and second portions are arranged in the y-axis direction of the cross section.

6. A fiber as claimed in claim 4, wherein said first and second portions are arranged concentrically.

7. A fiber as claimed in claim 4, wherein each of said first and second portions has a thickness between 0.01 and 0.40 μm.

8. A fiber as claimed in claim 1, wherein said different optical characteristics of said first and second portions include refractive indexes na, nb thereof.

9. A fiber as claimed in claim 8, wherein said refractive index na is smaller than said refractive index nb.

10. A fiber as claimed in claim 9, wherein a ratio of said refractive index nb to said refractive index na is between 1.01 and 1.40.

11. A fiber as claimed in claim 1, wherein when said alternate lamination has lengths dx, dy in the x-axis and y-axis directions, a ratio of said length dx to said length dy is between 0.1 and 16.0, and wherein said different optical characteristics of said first and second portions include refractive indexes na, nb thereof, said refractive index na being smaller than said refractive index nb, a ratio of said refractive index nb to said refractive index na being between 1.01 and 1.40.

12. A fiber as claimed in claim 4, wherein said clad includes the same resin as that of said second portion.

13. A fiber as claimed in claim 4, wherein said clad includes a resin different from said resins of said first and second portions.

14. A fiber as claimed in claim 13, wherein said clad corresponds to 5% or more per denier.

15. A fiber as claimed in claim 1, further comprising:

another alternate lamination including a first portion and a second portion adjacent thereto, said first and second portions having different optical characteristics, said optical characteristics being different from said optical characteristics of said alternate lamination.

16. A fiber as claimed in claim 15, wherein said another alternate lamination is arranged adjacent to said alternate lamination as viewed in the x-axis direction.

17. A fiber as claimed in claim 1, further comprising:

a reinforcement arranged in said alternate lamination.

18. A fiber as claimed in claim 17, wherein said reinforcement includes one of resins of said first and second portions.

19. A fiber as claimed in claim 17, wherein said reinfocement corresponds to 5% or more per denier.

20. A fiber as claimed in claim 4, wherein said resins of said first and second portions include polymers including polyester, polyacrylonitrile, polystyrene, polyamide, polypropylene, polyvinyl alcohol, polycarbonate, polymethyl methacrylate, polyether etherketone, polyparaphenylene terephthal amide, and polyphenylene sulfide, mixtures of two or more of said polymers, and copolymers thereof.

21. A fiber as claimed in claim 4, wherein said resin of said first portion includes polymetyl methacrylate, and said resin of said second portion includes coplymerized polyethylene terephthalate (PET).

22. A fiber as claimed in claim 4, wherein said resin of said first portion includes polymetyl methacrylate, and said resin of said second portion includes polycarbonate (PC).

23. A fiber as claimed in claim 4, wherein said resin of said first portion includes nylon 6 (Ny-6), and said resin of said second portion includes copolymerized polyethylene naphthalate.

24. A fiber as claimed in claim 4, wherein said first portion includes polyamide, and said second portion includes polyethylene terephthalate (PET).

25. A fiber as claimed in claim 24, wherein at least one of said first and second portions has a higher compatibility.

26. A fiber as claimed in claim 25, wherein said higher compatibility is ensured by addition of a compatible agent to said one of said first and second portions.

27. A fiber as claimed in claim 25, wherein said higher compatibility is ensured by copolymerization of said first and second portions.

28. A fiber as claimed in claim 26, wherein said compatible agent is selected from the group consisting of metallic salt of alkylbenzene sulfonic acid and polyester amide.

29. A fiber as claimed in claim 24, wherein said PET includes a dicarboxylic-acid component selected from the group consisting of phthalic and isophthalic acids, said dicarboxylic-acid component partly having a coordinate function given by a cationic agent.

30. A fiber as claimed in claim 29, wherein said cationic agent includes metallic salt of sulfonic acid.

31. A fiber as claimed in claim 30, wherein said dicarboxylic-acid component partly includes metallic salt of sulfoisophthalic acid.

* * * * *